US008200357B2

(12) United States Patent
Yamada

(10) Patent No.: US 8,200,357 B2
(45) Date of Patent: Jun. 12, 2012

(54) EMBROIDERY DATA CREATION APPARATUS AND COMPUTER-READABLE RECORDING MEDIUM STORING EMBROIDERY DATA CREATION PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1058 days.

(21) Appl. No.: 12/153,520

(22) Filed: May 20, 2008

(65) Prior Publication Data

US 2008/0289553 A1 Nov. 27, 2008

(30) Foreign Application Priority Data

May 22, 2007 (JP) ..... 2007-135019

(51) Int. Cl.
*D05C 5/02* (2006.01)

(52) U.S. Cl. ..... 700/138; 112/470.04

(58) Field of Classification Search ..... 112/470.01, 112/470.04, 470.06, 475.19; 700/136–138
See application file for complete search history.

(56) References Cited

U.S. PATENT DOCUMENTS

| | | | | |
|---|---|---|---|---|
| 4,520,745 | A | 6/1985 | Shinomiya et al. | |
| 5,343,401 | A * | 8/1994 | Goldberg et al. | 700/138 |
| 5,646,861 | A | 7/1997 | Kotaki | |
| 5,751,583 | A * | 5/1998 | Kyuno et al. | 700/137 |
| 5,839,380 | A * | 11/1998 | Muto | 700/138 |
| 6,167,823 | B1 * | 1/2001 | Laufer et al. | 112/475.19 |
| 6,192,292 | B1 * | 2/2001 | Taguchi | 700/138 |
| 6,324,441 | B1 * | 11/2001 | Yamada | 700/138 |
| 6,510,360 | B1 * | 1/2003 | Kaymer et al. | 700/138 |
| 6,629,015 | B2 | 9/2003 | Yamada | |
| 7,693,598 | B2 * | 4/2010 | Yamada | 700/138 |
| 7,946,235 | B2 * | 5/2011 | Yamada | 112/470.01 |
| 2002/0038162 | A1 * | 3/2002 | Yamada | 700/138 |
| 2005/0171628 | A1 * | 8/2005 | Suzuki et al. | 700/138 |
| 2007/0129840 | A1 | 6/2007 | Nobuyuki et al. | |

FOREIGN PATENT DOCUMENTS

| | | |
|---|---|---|
| JP | B2-61-16185 | 11/1983 |
| JP | A-05-146574 | 6/1993 |
| JP | A-07-316971 | 12/1995 |
| JP | A-11-019351 | 1/1999 |
| JP | A-2001-259268 | 9/2001 |
| JP | A-2003-154181 | 5/2003 |
| JP | A-2005-118215 | 5/2005 |

* cited by examiner

*Primary Examiner* — Nathan Durham
(74) *Attorney, Agent, or Firm* — Oliff & Berridge, PLC

(57) ABSTRACT

An embroidery data creation apparatus including an angle information calculation device that calculates an angle characteristic and an angle characteristic intensity for each of the pixels constituting image data, an angle information storage device that stores the angle characteristic and the angle characteristic intensity as angle information, a region specification device that specifies a change region in which the angle information is to be changed, an angle characteristic specification device that specifies a post-change angle characteristic, an angle characteristic change device that changes the respective angle characteristics of pixels included in the change region based on the post-change angle characteristic, a line segment data creation device that creates line segment data, a color data creation device that creates color data, and an embroidery data creation device that creates the embroidery data based on the line segment data and the color data.

20 Claims, 28 Drawing Sheets

FIG. 4

| | | |
|---|---|---|
| 100 | 50 | 50 |
| 200 | 100 | 50 |
| 200 | 200 | 100 |

FIG. 5

| | | |
|---|---|---|
| 50 | 0 | * |
| 100 | 50 | * |
| 0 | 100 | * |

FIG. 6

| | | |
|---|---|---|
| 0 | 0 | * |
| 0 | 0 | * |
| * | * | * |

FIG. 7

| | | |
|---|---|---|
| 100 | 50 | 0 |
| 0 | 100 | 50 |
| * | * | * |

FIG. 8

| | | |
|---|---|---|
| * | 150 | 50 |
| * | 100 | 150 |
| * | * | * |

FIG. 9

152

| ANGLE INFORMATION STORAGE AREA | | | | | | | | | |
|---|---|---|---|---|---|---|---|---|---|
| | | HORIZONTAL DIRECTION | | | | | | | |
| | | ... | m−1 | | m | | m+1 | | ... |
| VERTICAL DIRECTION | ⋮ | ⋮ | ⋮ | | ⋮ | | ⋮ | | ⋮ |
| | n−1 | ... | ANGLE CHARACTERISTIC | ANGLE CHARACTERISTIC INTENSITY | ANGLE CHARACTERISTIC | ANGLE CHARACTERISTIC INTENSITY | ANGLE CHARACTERISTIC | ANGLE CHARACTERISTIC INTENSITY | ... |
| | | | 30 | 45 | 40 | 5 | 30 | 8 | |
| | n | ... | ANGLE CHARACTERISTIC | ANGLE CHARACTERISTIC INTENSITY | ANGLE CHARACTERISTIC | ANGLE CHARACTERISTIC INTENSITY | ANGLE CHARACTERISTIC | ANGLE CHARACTERISTIC INTENSITY | ... |
| | | | 50 | 70 | 65→70 | 5 | 80 | 5 | |
| | n+1 | ... | ANGLE CHARACTERISTIC | ANGLE CHARACTERISTIC INTENSITY | ANGLE CHARACTERISTIC | ANGLE CHARACTERISTIC INTENSITY | ANGLE CHARACTERISTIC | ANGLE CHARACTERISTIC INTENSITY | ... |
| | | | 15 | 80 | 80 | 90 | 80 | 90 | |
| | ⋮ | ⋮ | ⋮ | | ⋮ | | ⋮ | | ⋮ |

FIG. 15

| | | | | | | | |
|---|---|---|---|---|---|---|---|
| 50 | 70 | 70 | 70 | 50 | 80 | 80 | 80 |
| 40 | 40 | 65 | 55 | 80 | 80 | 80 | 80 |
| 35 | 35 | 40 | 80 | 80 | 80 | 80 | 80 |
| 32 | 35 | 80 | 80 | 80 | 80 | 80 | 30 |
| 32 | 80 | 80 | 80 | 80 | 80 | 20 | 5 |
| 80 | 80 | 80 | 80 | 80 | 50 | 22 | 5 |
| 80 | 80 | 80 | 80 | 50 | 25 | 22 | 5 |
| 80 | 80 | 80 | 15 | 15 | 12 | 12 | 0 |

591

RELATED ART

EMBROIDERY DATA CREATION APPARATUS AND COMPUTER-READABLE RECORDING MEDIUM STORING EMBROIDERY DATA CREATION PROGRAM

CROSS-REFERENCE TO RELATED APPLICATION

This application claims priority to Japanese Patent Application No. 2007-135019, filed May 22, 2007, the disclosure of which is incorporated herein by reference in its entirety.

BACKGROUND

The present disclosure relates to an embroidery data creation apparatus and a computer-readable recording medium storing an embroidery data creation program. More specifically, the present disclosure relates to an embroidery data creation apparatus and a computer-readable recording medium storing an embroidery data creation program both of which are capable of adjusting a stitching direction when performing embroidery sewing based on a photographic image.

Conventionally, embroidery sewing may be performed based on an image of a photograph taken with a digital camera or of a photograph printed from a film. In such an example, image data of a photograph taken with a digital camera or image data obtained by scanning a photograph printed from a film with a scanner may be used. From the image data, line segment data and color data may be created. The line segment data indicates a shape of a stitch of a thread to be used for embroidery sewing, while the color data indicates a color of the stitch. Then, from the line segment data and the color data, embroidery data that indicates stitches for each thread color is created. For example, Japanese Patent Application Laid-Open Publication No. 2001-259268 discloses an embroidery data creation apparatus. The apparatus creates the embroidery data based on the line segment data that indicates the shape of a stitch so that stitches are aligned in not only one direction but also with a variety of directional angles within 360°, in order to make an embroidery result look closer to the image of the photograph. Specifically, for each of the pixels that constitute the image data, the apparatus calculates a stitching direction (angle characteristic) and its intensity (angle characteristic intensity) based on a relationship to its surrounding pixels, and uses the angle characteristic and angle characteristic intensity when creating the line segment data. The angle characteristic and the angle characteristic intensity are calculated based on luminance of a target pixel and luminance of surrounding pixels of the target pixel. The greater the difference between the luminance of the target pixel and the luminance of the surrounding pixels, the greater the value of the angle characteristic intensity becomes.

Further, for example, Japanese Patent Application Laid-Open Publication No. Hei 5-146574 discloses a data processing apparatus for embroidery sewing machines. The apparatus permits a user to specify a stitching direction in the embroidery data. In the data processing apparatus, the stitching direction is determined based on points that are specified on a borderline of an embroidery region in which embroidery sewing is to be performed. Furthermore, for example, Japanese Patent Application Laid-Open Publication No. Hei 11-19351 discloses a method for setting a stitching direction. According to this stitching direction setting method, the stitching direction in an embroidery region is specified by moving a mouse cursor over an embroidery region in which embroidery sewing is to be performed.

However, the above-described conventional embroidery data creation apparatus may in some examples create a stitch in an undesirable direction. For example, an original photographic image 90 of a design to be embroidered shown in FIG. 26 contains a background and a face of a girl wearing a cap, in which there is little difference in luminance in the background. FIG. 27 shows line segment data created based on the angle characteristics and angle characteristic intensities that are calculated from the photographic image shown in FIG. 26. Line segments of FIG. 27 indicate the shape of the stitches. Embroidery data can be created by assigning a color to each of those line segments. The background of the photographic image 90 may look more distinct in indicating the same area and may be more beautiful when the entire background is embroidered in the same stitching direction. In a region 911 shown in FIG. 27 corresponding to a region 91 shown in FIG. 26, the line segments in the left half of the region 911 that are close to the left end of the photographic image 90 are aligned in almost the same direction. On the other hand, the line segments in the right half of the region 911 that are close to the borderline with the cap are aligned in various directions. Because there is little difference in the luminance within the region 911, the created line segments tend to be aligned in the same direction, if the luminance is used to calculate the angle characteristics and the angle characteristic intensities. However, in the vicinity of the borderline between the background and the cap, the calculated values of the angle characteristics and the angle characteristic intensities are affected by the luminance of the cap, so that the created line segments are aligned in the different directions.

Further, a photographic image 80 shown in FIG. 28 contains a face of a male. For sewing embroidery based on the photographic image 80, a hair portion 81 may look more natural and beautiful if stitches are formed along an actual flow of the hair. However, the hair portion 81 in the photographic image 80 looks like the portion is painted all black. Therefore, if an embroidery data is created from such a photographic image 80, created line segments at the center of the hair portion 81 will be aligned in almost the same direction.

Moreover, according to the conventional data processing apparatuses and the conventional stitching direction setting methods, all stitching directions in a region are specified. Therefore, those conventional apparatuses and methods may not always be suitable for embroidery sewing based on a photographic image, in this example the sewing result can be made to look closer to the photographic image by forming stitches that have a variety of directional angles within 360° and fit in well with stitching directions and colors of the surrounding stitches.

SUMMARY

Various exemplary examples of the general principles herein provide an embroidery data creation apparatus and a computer-readable recording medium storing an embroidery data creation program, the apparatus and the program are capable of modifying a stitching direction in a predetermined region when performing embroidery based on a photographic image.

Exemplary examples provide an embroidery data creation apparatus that creates embroidery data to be used for embroidery sewing by a sewing machine based on image data constituted by an aggregation of a plurality of pixels to form an arbitrary image. The apparatus includes: an angle information calculation device that calculates an angle characteristic and an angle characteristic intensity for each of the pixels constituting the image data, the angle characteristic indicates a direction with a higher continuity of a color than that of conventional apparatuses, and the angle characteristic intensity indicates an intensity of the continuity; an angle information storage device that stores the angle characteristic and the angle characteristic intensity calculated by the angle information calculation device as angle information; a region specification device that specifies a change region in which the angle information stored in the angle information storage device is to be changed; an angle characteristic specification device that specifies a post-change angle characteristic, the post-change angle characteristic being a post-change quantity of the angle characteristic stored in the angle information storage device; an angle characteristic change device that changes the respective angle characteristics of pixels included in the change region specified by the region specification device based on the post-change angle characteristic specified by the angle characteristic specification device and that stores the angle characteristics into the angle information storage device after the angle characteristics are changed; a line segment data creation device that creates line segment data that indicates line segments based on the angle information stored in the angle information storage device, the line segments each being a trajectory of a thread to be disposed on each of the pixels; a color data creation device that creates color data that indicates a thread color for each of the line segments contained in the line segment data created by the line segment data creation device based on the image data; and an embroidery data creation device that creates the embroidery data based on the line segment data created by the line segment data creation device and the color data created by the color data creation device.

Exemplary examples also provide a computer-readable recording medium storing an embroidery data creation program that creates embroidery data to be used for embroidery sewing by a sewing machine based on image data constituted by an aggregation of a plurality of pixels to form an arbitrary image. The program includes: instructions for calculating an angle characteristic and an angle characteristic intensity for each of the pixels constituting the image data, the angle characteristic indicates a direction with a high continuity of a desired color, and the angle characteristic intensity indicates an intensity of the continuity; instructions for storing the angle characteristic and the angle characteristic intensity that are calculated as angle information; instructions for specifying a change region in which the angle information stored is to be changed, instructions for specifying a post-change angle characteristic, the post-change angle characteristic being a post-change quantity of the angle characteristic stored; instructions for changing the respective angle characteristics of pixels included in the change region specified, based on the post-change angle characteristic specified and storing the angle characteristics after change; instructions for creating line segment data that indicates line segments based on the angle information stored, the line segments each being a trajectory of a thread to be disposed on each of the pixels, instructions for creating color data that indicates a thread color for each of the line segments created, based on the image data; and instructions for creating the embroidery data based on the line segment data and the color data that are created.

BRIEF DESCRIPTION OF THE DRAWINGS

Exemplary examples of the disclosure will be described below in detail with reference to the accompanying drawings in which:

FIG. 4 is a schematic diagram showing luminance values of a target pixel and surrounding pixels of the target pixel.

FIG. 5 is a schematic diagram showing results of calculating an absolute value of a difference in luminance between each pixel and a right-hand pixel of the each pixel.

FIG. 6 is a schematic diagram showing results of calculating an absolute value of a difference in luminance between each pixel and a lower right pixel of the each pixel.

FIG. 7 is a schematic diagram showing results of calculating an absolute value of a difference in luminance between each pixel and a lower pixel of the each pixel.

FIG. 8 is a schematic diagram showing results of calculating an absolute value of a difference in luminance between each pixel and a lower left-hand pixel of the each pixel.

FIG. 9 is a schematic diagram showing a part of an angle information storage area.

FIG. 15 is a schematic diagram showing angle characteristic intensities after a change in the angle characteristic intensities of the example shown in FIG. 13.

DETAILED DESCRIPTION

The following describes an embroidery data creation apparatus 1 as one example according to the present disclosure, with reference to the drawings. The embroidery data creation apparatus 1 in the present example creates embroidery data that is used by an embroidery sewing machine 3 to embroider a design represented by and based on the image data.

Figure 1:
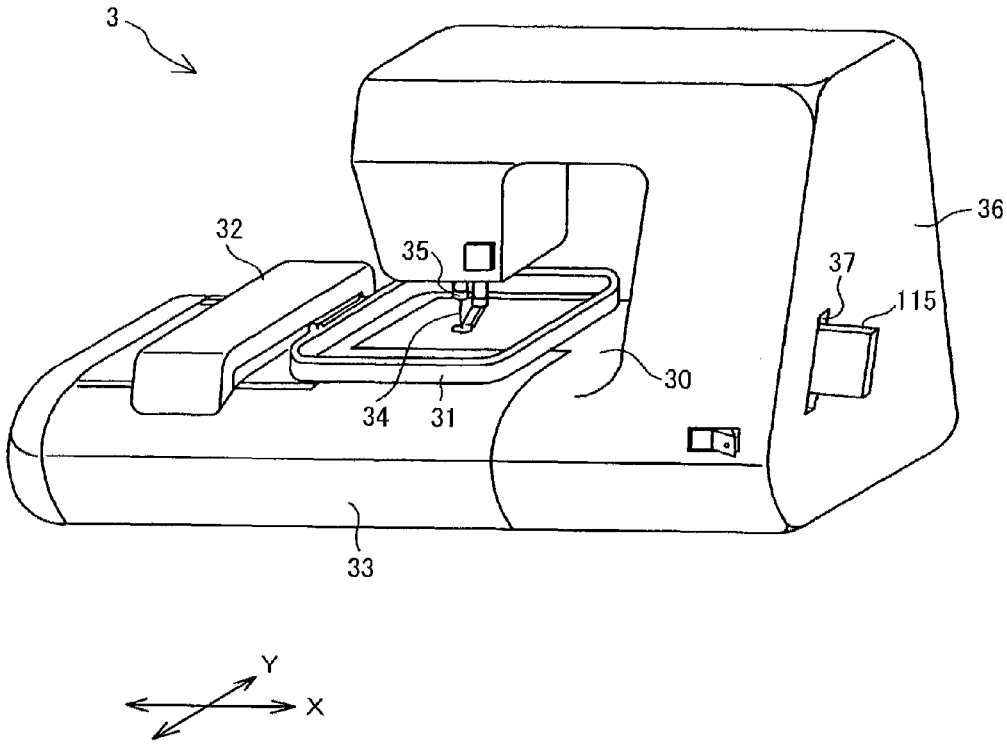
FIG. 1 is an external view of an embroidery sewing machine.

The embroidery sewing machine 3 is described below with reference to FIG. 1. The embroidery sewing machine 3 includes a Y-directional drive section 32 and an X-directional drive mechanism (not shown) that is contained in a body case 33. The y-directional drive section 32 and the X-directional drive mechanism can move an embroidery frame 31, which is disposed over a sewing machine bed 30 and holds a work cloth on which a design is to be embroidered, to a predetermined position indicated on an X-Y coordinates system unique to the apparatus. While the embroidery frame 31 is moved, a sewing needle 34 and a shuttle mechanism (not shown) are operated to embroider a predetermined design on the work cloth. The Y-directional drive section 32, the X-directional drive section, a needle bar 35 to which the sewing needle is attached, etc., are controlled by a control apparatus (not shown) constituted of a microcomputer built in the embroidery sewing machine 3. A memory card slot 37 is formed in the side surface of a pillar 36 of the embroidery sewing machine 3. By inserting a memory card 115 storing embroidery data into the memory card slot 37, the embroidery data created in the embroidery data creation apparatus 1 can be loaded into the embroidery sewing machine 3.

Figure 2:
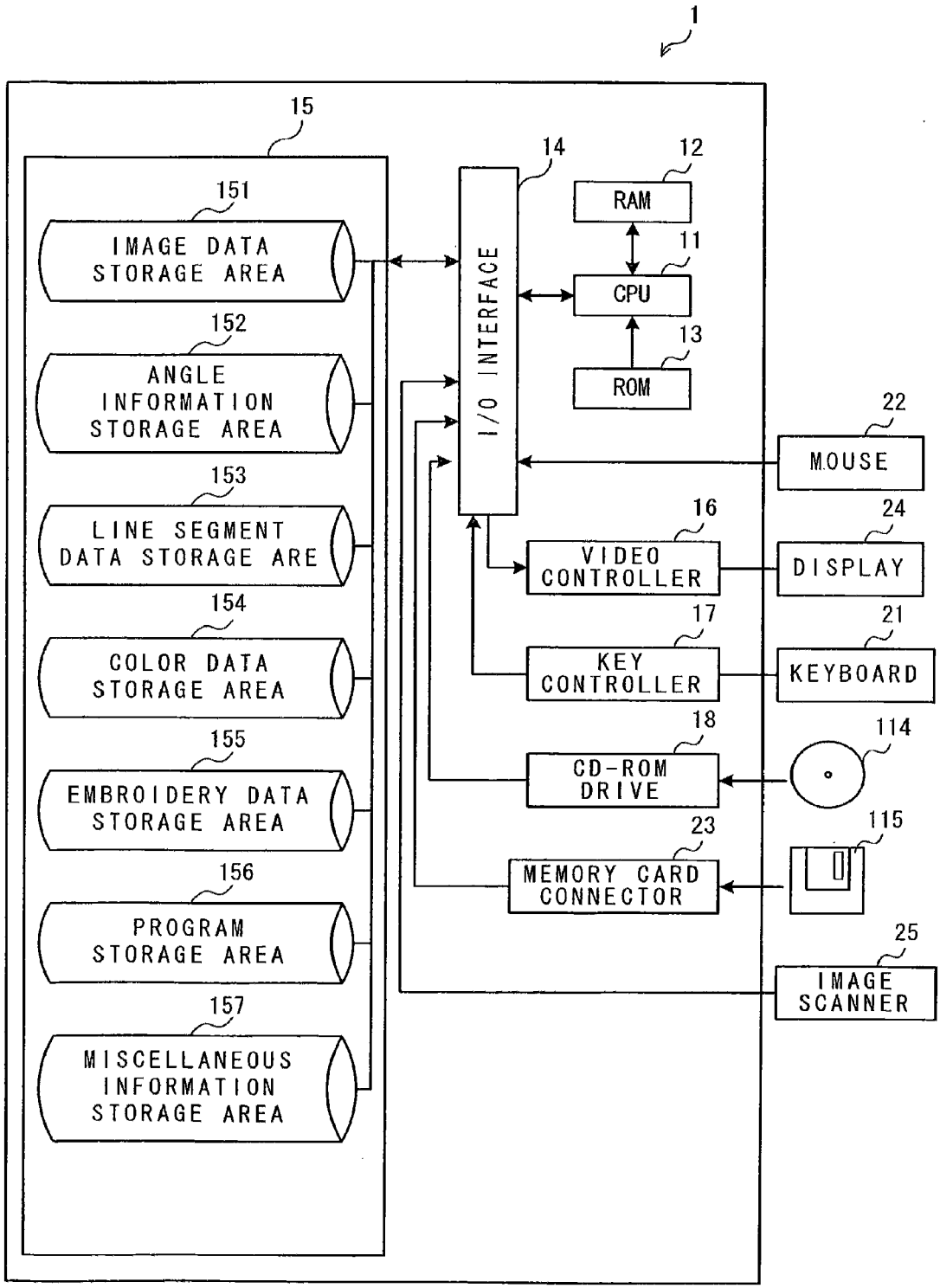
FIG. 2 is a block diagram showing an electrical configuration of an embroidery data creation apparatus.

The electrical configuration of the embroidery data creation apparatus 1 is described below with reference to FIG. 2. The embroidery data creation apparatus 1 may be a personal computer, to which a keyboard 21, a mouse 22, a display 24, and an image scanner 25 are connected. As shown in FIG. 2, the embroidery data creation apparatus 1 includes a CPU 11 that serves as a controller to control the embroidery data creation apparatus 1. A RAM 12 that temporarily stores various kinds of data, a ROM 13 that stores the BIOS etc., and an I/O interface 14 that mediates the delivery of data, are connected to the CPU 11. A hard disk drive 15 is connected to the I/O interface 14. The hard disk drive 15 has at least an image data storage area 151, an angle information storage area 152, a line segment data storage area 153, a color data storage area 154, an embroidery data storage area 155, a program storage area 156, and a miscellaneous information storage area 157.

The image data storage area 151 may store image data read by the image scanner 25, as an example. The angle information storage area 152 stores angle information containing an angle characteristic and an intensity of the angle characteristic (hereinafter referred to as "angle characteristic intensity") for each of pixels that constitute the image data. The line segment data storage area 153 stores line segment data created from the angle information. The line segment data represents each of the stitches for an embroidery design by a line segment. The color data storage area 154 stores color data created from the line segment data and the image data. The color data indicates a color of a line segment (color of a thread to be used for embroidery sewing) given by the line segment data. The embroidery data storage area 155 stores embroidery data created from the color data and the line segment data. The embroidery data is used when performing embroidery sewing with the embroidery sewing machine 3 and provides information such as a position of a stitch to be formed, a length of the stitch, etc. The program storage area 156 stores an embroidery data creation program, which is executed by the CPU 11, as an example. The miscellaneous information storage area 157 stores other miscellaneous information that is used in the embroidery data creation apparatus 1. The program may be stored in the ROM 13 if the embroidery data creation apparatus 1 is a dedicated apparatus not equipped with the hard disk drive 15.

The mouse 22, a video controller 16, a key controller 17, a CD-ROM drive 18, a memory card connector 23, and the image scanner 25 are respectively connected to the I/O interface 14. The display 24 is connected to the video controller 16, and the keyboard 21 is connected to the key controller 17. A CD-ROM 114, which may be inserted into the CD-ROM drive 18, stores the embroidery data creation program, which is a control program to control the embroidery data creation apparatus 1. The embroidery data creation program is set up from the CD-ROM 114 into the hard disk drive 15, and stored into the program storage area 156. The memory card connector 23 enables both the reading of data from and the writing of data into the memory card 115.

The angle information stored in the angle information storage area 152 is described below. The angle information indicates an angle characteristic and an angle characteristic intensity, which are separate values calculated for each pixel. The angle characteristic indicates in which direction (at which angle) the color of the pixel shows continuity when the color of the pixel is compared with the colors of the surrounding pixels. The angle characteristic intensity indicates an intensity of the continuity of the color. The angle characteristic does not only represent the continuity of the color of the pixel in relation to the adjacent pixels, but rather may represent the color continuity in a wider region. Thus, the angle characteristic is a numeric conversion of a direction in which a person who looks at an image from a distance perceives continuity of the color in the image. When creating a line segment of a pixel, the inclination of the line segment is assumed as an angle indicated by the angle characteristic. The angle characteristic intensity of a pixel is used in comparison with the angle characteristics of the surrounding pixels when determining whether to perform embroidery sewing indicated by the line segment of the pixel, or not to perform embroidery sewing by deleting the line segment.

The angle information storage area 152 is a two-dimensional array. In a vertical dimension, arrays may be disposed as the number of pixels in the vertical direction, and in a horizontal dimension, arrays may be disposed as the number of pixels in the horizontal direction (see FIG. 9). Each element of the two-dimensional array has an angle characteristic field and an angle characteristic intensity field. In other words, an angle characteristic and an angle characteristic intensity of one pixel are both stored as one array element. Therefore, the angle information storage area 152 can store the same number of angle characteristics and angle characteristic intensities as the number of pixels.

A processing procedure to create embroidery data from image data is described below with reference to FIG. 3. The processing of a flowchart shown in FIG. 3 is performed by the CPU 11 in the embroidery data creation apparatus 1 in accordance with the embroidery data creation program.

Figure 3:
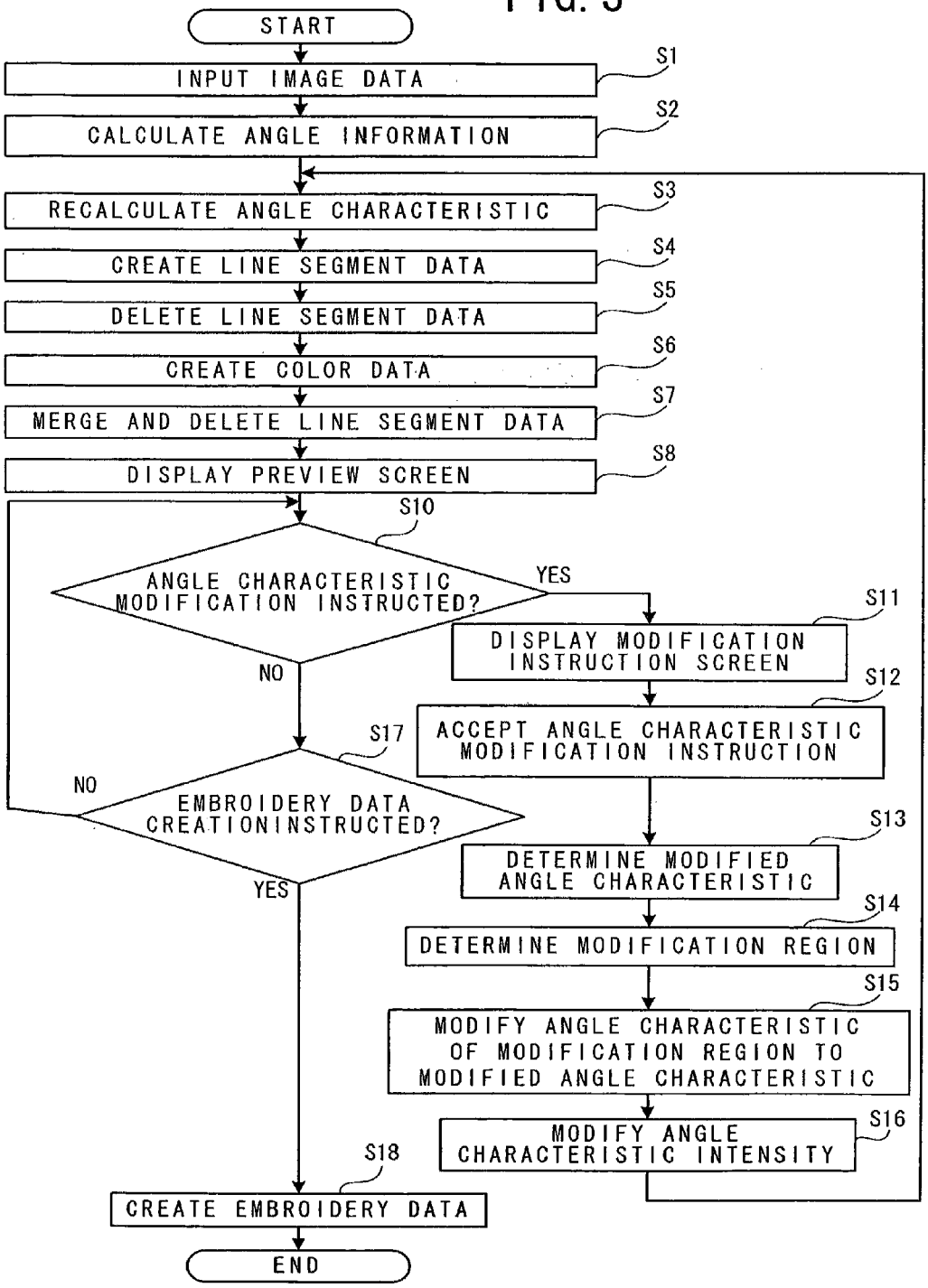
FIG. 3 is a flowchart showing a processing procedure of creating embroidery data.

As shown in FIG. 3, image data required to create an embroidery data is inputted in step 1 (S1). For example, input of the image data can be realized by operating the image scanner 25 to take in an image, or by specifying a file of the image data stored in an external storage device or in the hard disk drive 15. The input image data is stored into the image data storage area 151. The image data is constituted by a plurality of pixels, each of which has information about a hue, which is an index of a color shade, a brightness, that is an index of brightness, a chroma saturation, that is an index of vividness, etc. The pixels are disposed in a shape of a matrix to form an image.

After the image data required to create an embroidery data is inputted and stored into the image data storage area 151 (S1), the angle characteristic and the angle characteristic intensity are calculated for each of the pixels of the image data to create the angle information in step (S2). A method of calculating the angle characteristic and the angle characteristic intensity is specifically described below with reference to FIGS. 5-7.

First, the input image data is gray-scaled. Gray-scaling refers to a process of converting a color image into a monochromatic image. Through the gray-scaling process, a gray value (a luminance value) representing the luminance of one color component of the monochromatic image is determined on the basis of the values of a plurality of color components of the color image. For example, a half of a sum of a maximum value and a minimum value of pixel data pieces (R, G, B) of each pixel constituting the image data composed of three primary colors of red, green, and blue, can be set as a luminance value of the pixel, which is the index of the brightness. If a pixel has RGB values (200, 100, 50), the luminance value of the pixel can be obtained as (200+50)/2=125. The method of gray-scaling image data is not limited to that as described above. For example, it is also possible to set a maximum value of pixel data pieces (R, G, B) as the luminance value.

Next, transformation processing through a known high-pass filter is performed on the gray-scaled image data. Based on the image transformed through the high-pass filter, the angle characteristic and the angle characteristic intensity are calculated for each of the pixels constituting the image. The angle characteristic and the angle characteristic intensity can be calculated as follows. First, one of the pixels constituting the image is taken as a target pixel. The angle characteristic of the pixel data of the target pixel is calculated, corresponding to the N number of dots of pixels surrounding the target pixel. Hereinafter, a region constituted by the target pixel and the surrounding N number of dots of pixels is referred to as a target region. Here, N=1 is supposed for simplification of the explanation. "N" represents a distance from a target pixel to any one of the surrounding pixels to be referenced. Accordingly, if N=1, only pixels adjacent to the target pixel are referenced. If N=2, pixels adjacent to the target pixel and the pixels surrounding the adjacent pixels are referenced.

For example, nine (=3×3) pixels including the target pixel in the center have the respective pixel data pieces having such luminance values as shown in FIG. 4. The luminance value is specified by a numeral in the range between 0 and 255. More specifically, a luminance value of 0 corresponds to black and a luminance value of 255 corresponds to white. In FIG. 4, the target pixel has a luminance value of 100, and the adjacent surrounding pixels sequentially have luminance values 100, 50, 50, 50, 100, 200, 200, and 200 clockwise from the upper left corner.

By calculating an absolute value of a difference (an absolute value of a difference in luminance values) between pixel data of each pixel and a rightward pixel thereof, a result can be obtained as shown in FIG. 5. Because the rightmost three pixels have no further rightward pixel, the absolute values of the respective differences cannot be calculated. Therefore, the values are indicated by "*". The target pixel has the luminance value "100" and the rightward pixel thereof has the luminance value "50", so that the absolute value of the difference is "50". Subsequently, the absolute values of the respective differences are also calculated for the lower right direction, lower direction, and lower left direction, and results can be obtained as shown in FIGS. 6, 7, and 8, respectively. Based on the calculation results, a normal line-directional angle of the angle characteristic is calculated. The normal line-directional angle of the angle characteristic corresponds to a higher discontinuity of the pixel data in the target region. Therefore, by adding 90 degrees to the normal-directional angle of the angle characteristic, the angle characteristic can be obtained.

Specifically, sums Th, Tc, Td, and Te are calculated from the calculation results (absolute values of respective differences) that have been obtained for respective directions. Supposing that the sum of the right-directional calculation results is Th, the sum of the lower right-directional calculation results is Tc, the sum of the lower-directional calculation results is Td, and the lower left-directional calculation results is Te, Th, Tc, Td, and Te can respectively be obtained as Tb=300, Tc=0, Td=300, and Te=450. From the sums Th, Tc, Td, and Te, a sum of horizontal components and a sum of vertical components are calculated, and then an arctangent value is calculated. In this example, it is assumed that the horizontal and vertical components in the lower right direction and the horizontal and vertical components in the lower left direction offset each other.

If the lower right-directional (45-degree directional) sum Tc is greater than the lower left-directional (135-degree directional) sum Te (Tc>Te), the lower right direction is taken as + (plus) and the lower left direction is taken as − (minus) for the horizontal and vertical components, because a resultant value is expected to be 0 to 90 degrees. In this example, the horizontal component sum is represented as Tb+Tc−Te, and the vertical component sum is represented as Td+Tc−Te.

Conversely, if the lower right-directional sum Tc is smaller than the lower left-directional sum Te (Tc<Te), the lower left direction is taken as + (plus) and the upper left direction is taken as − (minus) for the horizontal and vertical components, because a resultant value is expected to be 90 to 180 degrees. In this example, the horizontal component sum is represented as Th−Tc+Te, and the vertical component sum is represented as Td−Tc+Te. As discussed above, because the resultant value is expected to be 90 to 180 degrees, the value is multiplied by "−1" prior to calculating an arctangent value.

For example, because Tc is smaller than Te in the examples shown in FIGS. 5-8, the respective resultant value is expected to fall within the range between 90 and 180 degrees. The horizontal component sum is obtained as Th−Tc+Te=300−0+450=750, and the vertical component sum is obtained as Td−Tc+Te=300−0+450=750. Therefore, the value is multiplied by −1 prior to the calculation of an arctangent value, resulting in arctan(−750/750)=−45 (degrees). The obtained angle represents the normal-directional angle of the angle characteristic. The angle indicates a direction in which the level of discontinuity of the pixel data is higher in the target region. Therefore, in this example, the target pixel has an angle characteristic of −45+90=45 (degrees). As described above, because the lower right direction should be + (plus) for the horizontal and vertical components, the obtained value of 45 degrees indicates the lower right direction. In the above example, the angle characteristic is calculated based on a difference in color information between the target pixel and the surrounding pixels. Although the above example employs the brightness (a luminance value) that corresponds to each pixel as the color information, the same results can be obtained employing the chroma saturation or the hue, alternatively.

Further, an angle characteristic intensity can be calculated using the following Equation (1). A total sum of differences in luminance values is a sum of the sums Tb, Tc, Td, and Te. Accordingly, the angle characteristic intensity can be obtained as $\{(300+0+300+450)\times(255-100)\}/\{255\times(1\times4)2\}=39.9$. The angle characteristic indicates a direction in which the brightness changes, and the angle characteristic intensity indicates an intensity of a change in the brightness.

$$\text{Angle Characteristic Intensity} = \frac{\text{Sum of Differences}\times(255-\text{Value of TargetPixel})}{255\times(N\times4)^2} \quad (1)$$

In the present example, by applying a known Prewitt operator or Sobel operator on the gray-scaled image data, the angle characteristic and the angle characteristic intensity can also be obtained for each of the pixels that constitute the image. For example, when of using the Sobel operator, a result of the application of a horizontal operator and a result of the application of a vertical operator in coordinates (x, y) are sx and sy, respectively. The angle characteristic and the angle characteristic intensity in the coordinates (x, y) can be calculated using the following Equations (2) and (3), respectively.

$$\text{Angle Characteristic}=\tan-1(sy/sx) \quad (2)$$

$$\text{Angle Characteristic Intensity}=\sqrt{sx\cdot sx+sy\cdot sy} \quad (3)$$

In such a manner, the angle characteristic and the angle characteristic intensity corresponding to each of the pixels of the image data are calculated and stored as the angle information into the angle information storage area 152 (S2 in FIG. 3). If the image data has a size of 150×150 pixels, the respective angle characteristics and the respective angle characteristic intensities are stored in the 150×150 array in the angle information storage area 152.

Subsequently, the angle characteristic is recalculated in step 3 (S3). When a pixel has an angle characteristic intensity that is smaller than the predetermined threshold value, the angle characteristic of the pixel may not accurately be reflected in the line segment data. Therefore, a new angle characteristic is calculated in reference to the angle characteristics of the surrounding pixels. It is thus possible to create the line segment data that fits in well with the surroundings. Therefore, it is possible to create the embroidery data that can recreate a natural image.

Specifically, each of the pixels is sequentially taken as the target pixel, and it is determined whether the angle characteristic intensity of the target pixel is equal to or less than the predetermined threshold value. If the angle characteristic intensity is not equal to or less than the predetermined threshold value, it is not necessary to recalculate the angle characteristic of the target value. If the angle characteristic intensity is equal to or less than the predetermined threshold value, the angle characteristic of the target value is recalculated. Specifically, the pixels surrounding the target pixel are scanned to specify those pixels having an angle characteristic that is greater than the threshold value. With respect to the specified pixels, a sum S1 of respective products of cosine values of the angle characteristics and the angle characteristic intensities and a sum S2 of respective products of sine values of the angle characteristics and the characteristic intensities are obtained. Then, an arctangent value of sums S2/S1 is set as a new angle characteristic, to determine an angle component.

In an example shown in FIG. 9, the target pixel is represented as (m, n). When it is assumed that "surrounding pixels" are adjacent pixels of the target pixel, the surrounding pixels are represented as (m−1, n−1), (m, n−1), (m+1, n−1), (m−1, n), (m+1, n), (m−1, n+1), (m, n+1), and (m+1, n+1). When the angle characteristic intensity has a value of 0 to 100 and the threshold value is 10, because the target pixel (m, n) has an angle characteristic intensity of five (5), the angle characteristic of the target pixel is recalculated. Specifically, the pixels with an angle characteristic intensity that is greater than the threshold value have angle characteristics of 30 for (m−1, n−1), 100 for (m+1 n−1), 50 for (m−1, n), 15 for (m−1, n+1), and 80 for (m, n+1). Therefore, as described above, sum S1 can be calculated as sum S1=cos(45)×30+cos(70)×50+cos(80)×15+cos(90)×80+cos(60)×100=90.92. Sum S2 can also be calculated as sum S2=sin(45)×30+sin(70)×50+sin(80)×15+sin(90)×80+sin(60)×100=249.57. Therefore, the angle characteristic of the target pixel can be calculated as $\tan^{-1}(249.57/90.92)=70.02\approx70$. Accordingly, the angle characteristic of the target pixel (m, n) in the angle information storage area 152 is changed to 70.

Figure 10:
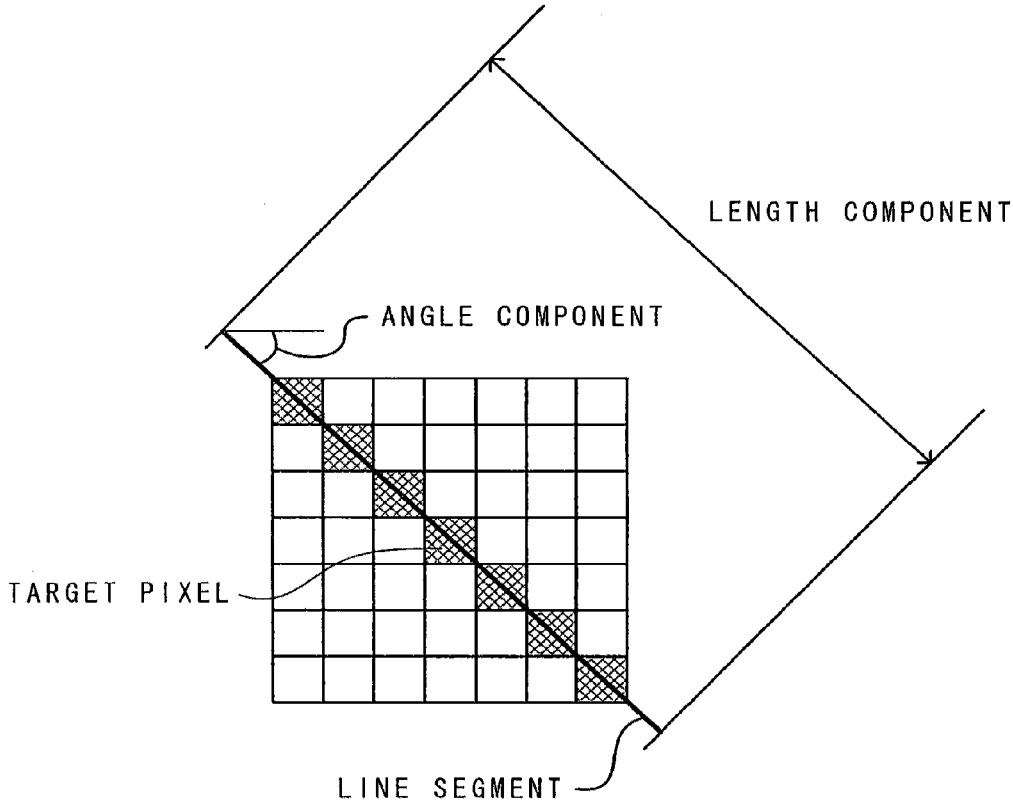
FIG. 10 is a schematic diagram illustrating line segment information created based on a target pixel at the center.

Subsequently, the line segment data is created from the angle information stored in the angle information storage area 152, and stored into the line segment data storage area 153 in step 4 (S4). Specifically, the line segment information that includes an angle component and a length component for each pixel is first created. An aggregate of the line segment information pieces created from the angle information constitutes the line segment data. The angle characteristic stored in the angle information storage area 152 is set as the angle component. A preset fixed value or an input value inputted by the user may be set as the length component. For example, the line segment information is created to represent a line segment that has the angle component and the length component set as described above and is disposed to have the target pixel at the center as shown in FIG. 10. FIG. 10 shows an example where the angle component is 45 degrees.

If the line segment information is created for all of the pixels that constitute the image, sewing quality may be deteriorated when embroidery sewing is performed in accordance with the embroidery data created on the basis of the line segment data. In particular, extremely large number of stitches may be made, or the same portion may be sewn many times. Further, if the line segment information is also created for such pixels so as to have a small angle characteristic intensity, the embroidery data that does not effectively reflects characteristics of an entire image may be created. To solve these problems, the pixels that constitute the image are sequentially scanned from the left to the right and from the top to the bottom, to create the line segment information only for such pixels so as to have an angle characteristic intensity greater than the predetermined threshold value. A preset fixed value or an input value inputted by the user may be set as the threshold value for the angle characteristic intensity.

After the line segment data is created (S4), the line segment information of line segments that are inappropriate or unnecessary in the later-performed creation of embroidery data, are deleted from the line segment data stored in the line segment data storage area 153 in step 5 (S5). Specifically, all of the pixels constituting the image are sequentially scanned from the upper left corner of the pixels for which the line segment information has been created are subjected to the following processing.

First, if any line segment information around the target pixel has an angle approximate to the angle of the target pixel, the line segment information that has a smaller angle characteristic intensity is deleted. More specifically, all of the pixels present around the target pixel in a predetermined range are scanned. The predetermined range is positioned on an extended line of the line segment identified by the line segment information created for the target pixel. If there is any pixel that has an angle characteristic approximate to the angle characteristic of the target pixel and has an angle characteristic intensity smaller than the angle characteristic intensity of the target pixel, the line segment information created for the pixel is deleted. Conversely, if there is any pixel that has an angle characteristic approximate to the angle characteristic of the target pixel and has a greater angle characteristic intensity than the angle characteristic intensity of the target pixel, the line segment information created for the target pixel is deleted. In the present example, the scan range is assumed as n times as large as the length component in the line segment information created for the target pixel. The value n that determines the scan range and ±θ that determines the approximate range of the angle characteristics, may be preset fixed values or input values inputted by the user, respectively.

After the unnecessary line segment information is deleted in such a manner (S5), the color data of the line segments is then created in step 6 (S6). When creating the color data, the image data and the line segment data are used. When determining a color component, it is necessary to set thread colors of embroidery threads to be used. When setting the thread colors, the user inputs the number of the thread colors of the embroidery threads to be used, the thread color information (RGB values) are of the same number of the embroidery threads as the number of the thread colors, and color codes. Based on the inputted contents, a thread color correspondence table is created. An order for the thread colors in which the threads colors are to be used in sewing is also set. The thread colors of the embroidery threads and the order for the thread colors may be preset or inputted by the user in accordance with an entry screen. Further, the user may select the desired thread colors from among the thread colors for which a thread color correspondence table is created beforehand.

First, a reference height is set. The reference height is required to determine a range in image data within which colors are referenced (hereinafter referred to as reference region). One example of a reference region is a region enclosed by two parallel lines sandwiching a line segment and two perpendicular lines to the two ends of the line segment. The reference height indicates a distance from the line segment identified by the line segment information to the parallel line. For example, as the reference height, the number of pixels or a length of a result of the embroidery can be used. Alternatively, the reference region may be preset or inputted by the user. To draw the line segment, an image having the same size as the image data is created as a transformed image in a transformed image storage area (not shown) of the RAM 12.

Next, when drawing a line segment identified by the line segment information created for a target pixel on the transformed image, a reference region is set. A sum Cs1 of R-, G-, and B-values of each the pixels included in the reference region is calculated. Further, the number of the pixels used to calculate the sum Cs1 is assumed to be d1. In the calculation of the sum Cs1, the pixels through which the line segment is not drawn (does not pass) and the pixels through which a line segment that is to be drawn are not used.

Further, a sum Cs2 of R-, G-, and B-values of each the pixels included in a corresponding reference region in the image data is calculated. The number of the pixels in the corresponding reference region in the image data is assumed to be d2.

The number of the pixels of the line segment that is to be drawn is assumed to be s1, in order to calculate a value of CL that satisfies an equation (Cs1+CL×s1)/(s1+d1)=Cs2/d2. The equation defines that when a color CL is set to the line segment that is to be drawn, an average value of the colors of the line segments in the reference region equals to an average value of the colors in the corresponding reference region in the original image.

Finally, a thread color having a smallest distance in an RGB space to the color CL of the line segment is specified from among the inputted thread colors, and the specified thread color is stored into the color data storage area 154 as a color component of the line segment. The distance d in the RGB space can be calculated by the following Equation (4), assuming that the RGB values of the calculated color CL are r0, g0, and b0 and the RGB values of the inputted thread color are rn, gn, and bn, respectively.

$$d=\sqrt{(r0-rn)^2+(g0-gn)^2+(b0-bn)^2} \quad (4)$$

After the color data is created in such a manner, each line segment information piece is again analyzed in a condition where the color component is added, and the line segment information pieces in the line segment data may be merged and deleted in step 7 (S7). First, if there are line segments of the same color overlapping on the same line among the line segments identified by the respective line segment data pieces, the line segment data pieces are merged into one line segment data piece. More specifically, if there is a plurality of line segments that have the same angle component and color component and that partially overlap with each other, the line segment data pieces of the line segments are merged. By merging a plurality of line segment data pieces into one line segment data piece in such a manner, it is possible to decrease the number of stitches used for sewing the embroidery. Therefore, it is possible to create embroidery data that enables efficient embroidery sewing without deteriorating the sewing quality.

Further, when the line segments are disposed in a sewing order set at S6 and if any one of the line segments having a certain color component is partially covered by another line segment having another color component and disposed later, an exposure ratio of the line segment may be calculated. More specifically, the exposure ratio is calculated for the line segment in a condition where the line segment is partially covered by another line segment having the different color component. If there is a line segment having an exposure ratio smaller than a predetermined threshold value (minimum exposure ratio), the line segment data thereof is deleted. By deleting the line segment data with a small exposure ratio, which has little significance, it is possible to reduce the number of stitches in the end. Therefore, it is possible to create embroidery data that enables efficient embroidery sewing without deteriorating the sewing quality. The exposure ratio threshold value (minimum exposure ratio) may be preset to a fixed value or inputted by the user.

Figure 11:
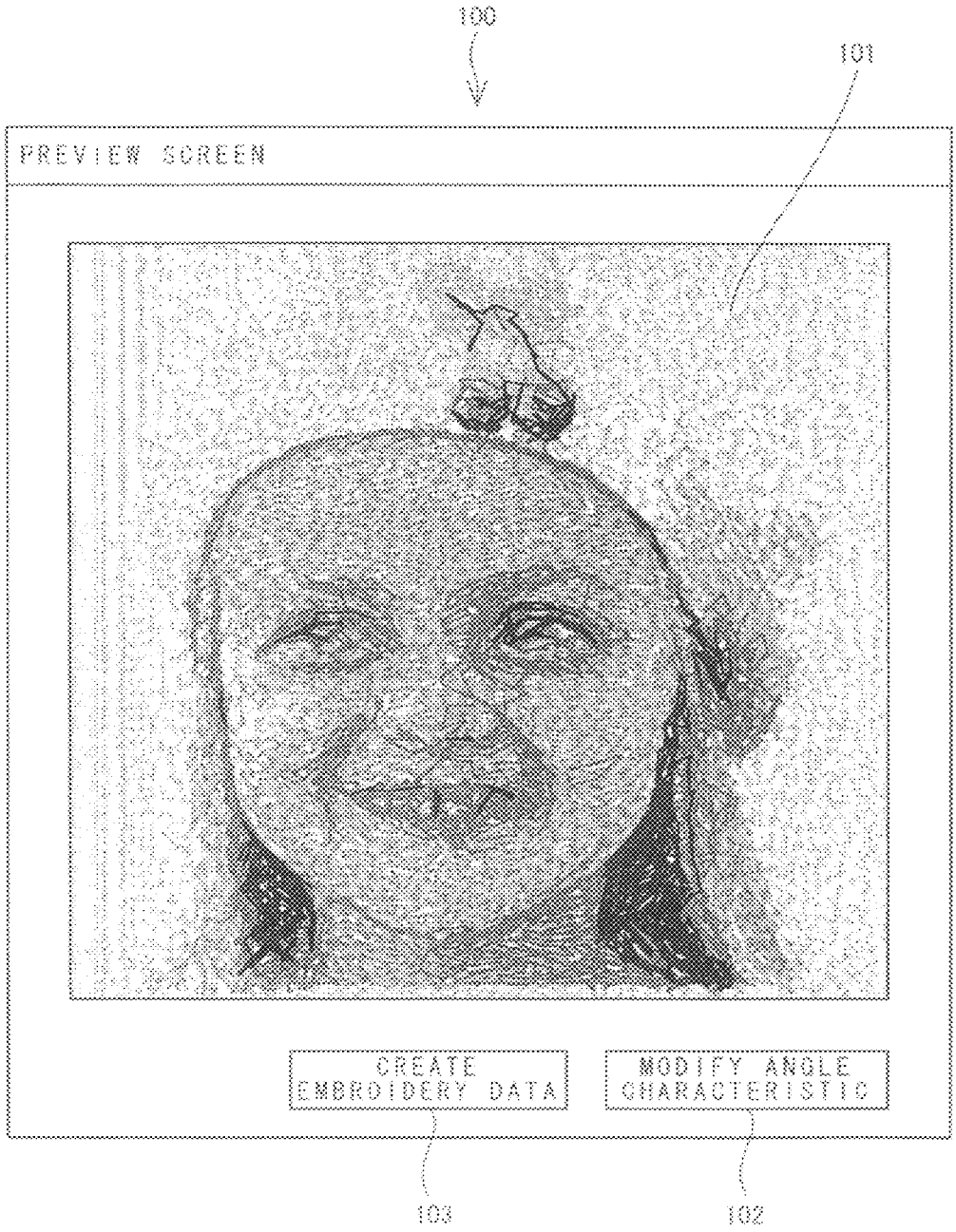
FIG. 11 is an illustration showing a preview screen.

Next, a preview screen 100 is displayed in step 8 (S8). As shown in FIG. 11, the preview screen 100 has at least a preview image display region 101, an angle characteristic modification button 102, and an embroidery data creation button 103. In the preview image display region 101, a preview image, which represents a presumed result of embroidery sewing based on the image data, is displayed. The preview image is a color image based on the line segment data and the color data. More specifically, the preview image shows the line segments indicated by the line segment data colored with colors (the colors of the embroidery threads) indicated by the color data.

After the preview screen 100 is displayed (S8), it is determined whether the angle characteristic modification button 102 is selected to instruct modification of the angle characteristic in step 10 (S10). If modification of the angle characteristic is instructed (YES at S10), processing for modifying the angle information is performed in steps 11-16 (S11-S16). Then, the process returns to S3 and the angle characteristic is recalculated (S3). Based on the modified angle information and the recalculated angle information, the line segment data and color data are created (S4-S7), and the preview screen 100 is displayed again (S8).

Figure 12:
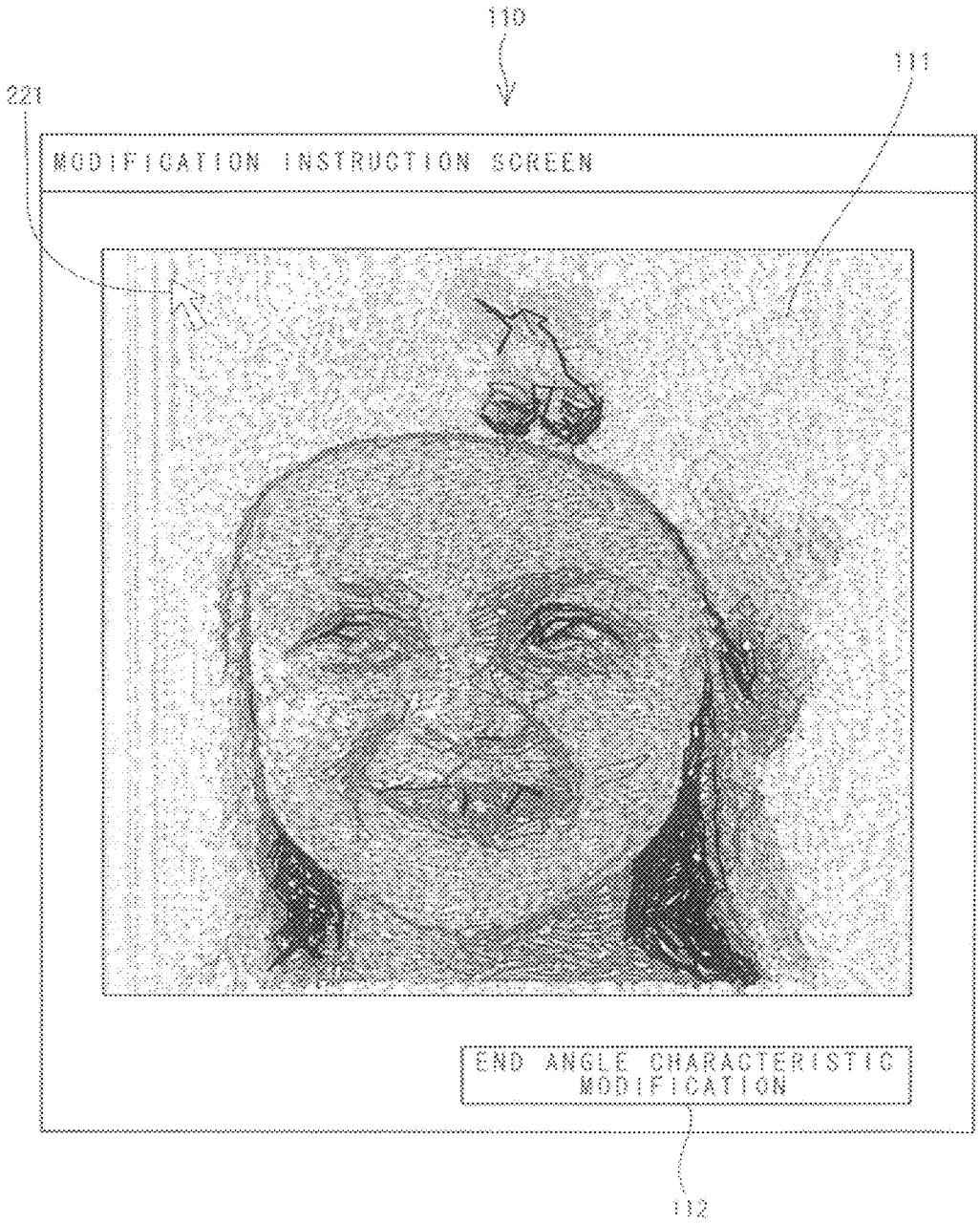
FIG. 12 is an illustration showing a modification instruction screen.

Next, the processing (S11-S16) for modifying the angle information will be described below. First, the display is switched from the preview screen 100 to a modification instruction screen 110 for instructing modification of the angle characteristic (see FIG. 12) in step 11 (S11). As shown in FIG. 12, the modification instruction screen 110 has a preview image display region 111 and a modification termination button 112. In the preview image display region 111, a preview image is displayed in the same way as on the preview screen 100. Further, in the preview image display region 111, an input from the mouse 22 can be accepted.

Figure 13:
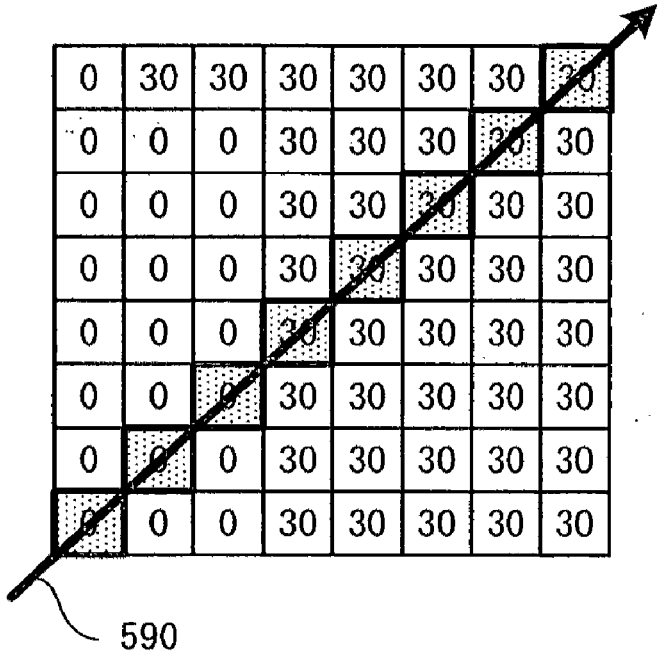
FIG. 13 is a schematic diagram showing angle of some pixels.

An input from the mouse 22 is accepted in step 12 (S12). For example, if the user moves a mouse pointer 221 in the preview image display region 111 by dragging the mouse 22, a movement trajectory of the mouse pointer 221 is accepted as an input from the mouse 22. In the present example, a region in which the angle characteristic is to be modified is determined, based on the movement trajectory along which the mouse pointer 221 has moved when the mouse 22 was dragged by a user. Further, the movement trajectory of the mouse pointer 221 is approximated to a straight line, and the angle of the straight line is used as a modified angle characteristic. That is, by dragging the mouse 22 in a desired direction in which a portion of the sewing direction that is desired to be changed in the preview image display region 111, the user can specify for which pixels the angle characteristics are to be modified and in which direction the sewing direction is to be changed. Pixels corresponding to the movement trajectory of the mouse pointer 221 (pixels through which the mouse pointer 221 has passed) are set as modification target pixels, and coordinates thereof are then stored into the RAM 12. For example, an arrow shown in FIG. 13, which goes from the lower left corner to the upper right corner of in the figure, represents the movement trajectory 590 of the mouse pointer 221. Shaded pixels are the modification target pixels. If the modification termination button 112 is selected, it is determined that the acceptance of the inputs from the mouse 22 has been finished. In other words, until the modification termination button 112 is selected, inputs from the mouse 22 dragged in the preview image display region 111 may be continuously accepted.

Figure 14:
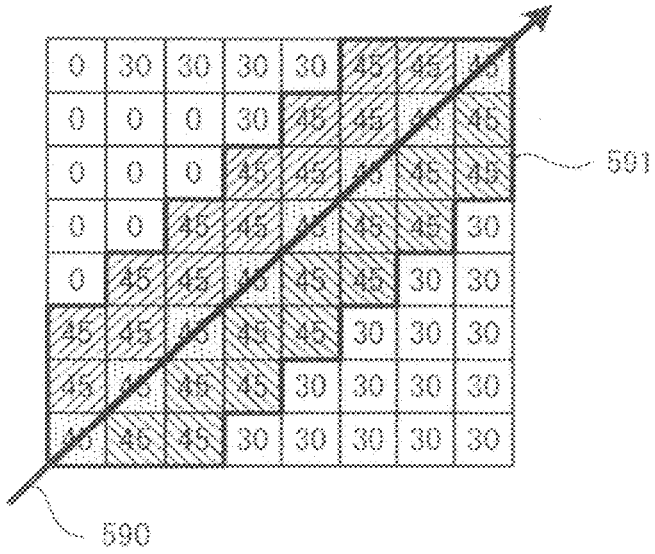
FIG. 14 is a schematic diagram showing angle characteristics after a change in the angle characteristics of an example shown in FIG. 13 are changed.

Subsequently, a modified angle characteristic is determined based on the movement trajectory of the mouse pointer 221 in step 13 (S13). In the present example, coordinates of the modification target pixels are approximated to a straight line, and the inclination of the straight line is taken as the modified angle characteristic and stored into the RAM 12. In an example shown in FIG. 13, because the approximated straight line has an inclination of 45°, the modified angle characteristic is obtained as 45. Subsequently, a modification region in which the angle characteristics and the angle characteristic intensities are to be modified are determined in step 14 (S14). The angle characteristics stored in the angle information storage area 152 are modified to the modified angle characteristic that is determined in S13 for the pixels in the modification region in step 15 (S15). In the present example, a region corresponding to two pixels consecutive to the modification target pixels in the vertical and horizontal directions (hereinafter referred to as neighboring pixels) are set as the modification region. With respect to the pixels shown in FIG. 13, hatched pixels and the shaded modification target pixels shown in FIG. 14 provide the pixels in the modification region 591, and the value 45 determined at S13 are set as the angle characteristics of the pixels in the modification region 591.

Subsequently, the angle characteristic intensities of the pixels in the modification region are modified in step 16 (S16). In the present example, the angle characteristic intensity is modified to a predetermined value (e.g., 80). With respect to the pixels shown in FIG. 13, the angle characteristic intensities are modified to 80 for all the pixels in the modification region 591, as shown in FIG. 15. Such processing of S13 through S16 is performed on all the modification target pixels inputted at S12.

After the angle information is modified in such a manner (S11-S16), the process returns to S3 to recalculate the angle characteristics (S3). The line segment data and the color data are created based on the modified and then recalculated angle information (S4-S7). Then, the preview screen 100 is displayed again (S8).

Figure 16:
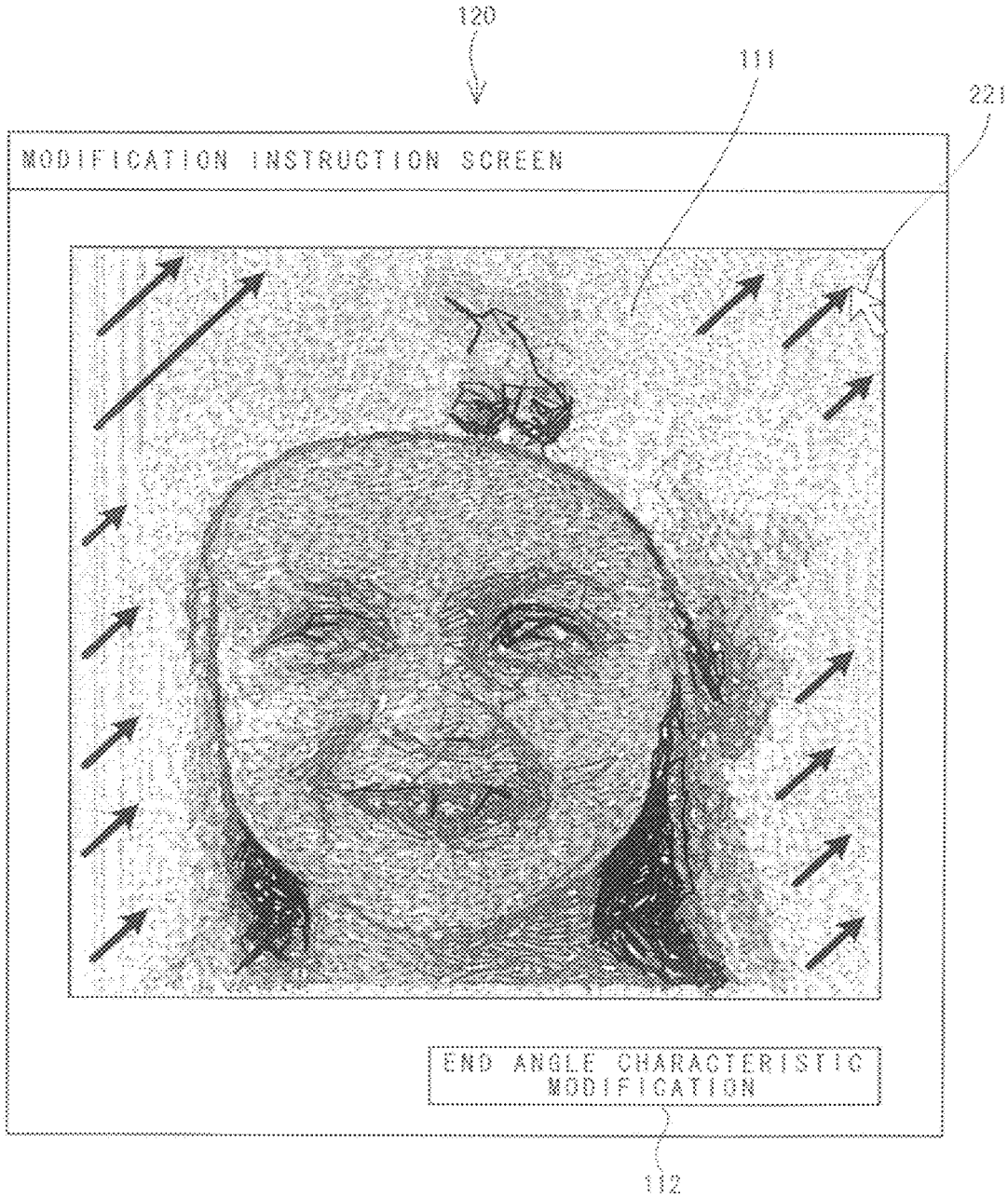
FIG. 16 is an illustration showing instructions for an angle characteristic modification given on the modification instruction screen shown in FIG. 12.
Figure 17:
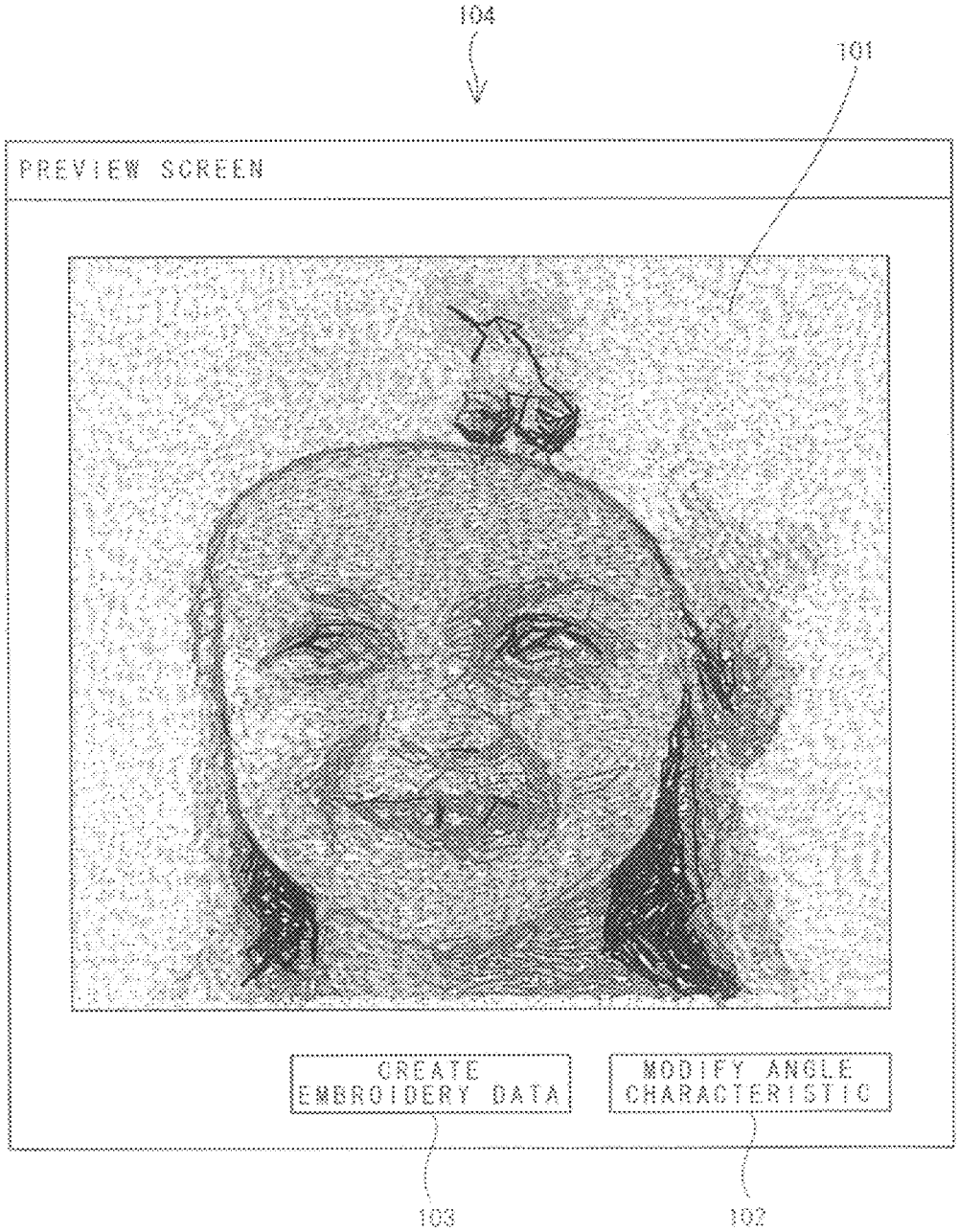
FIG. 17 is an illustration showing the preview screen updated according to the modification instructions shown in FIG. 16.

For example, fourteen black arrows in the preview image display region 111 shown in FIG. 16 indicate the moving trajectories of the mouse pointer 221. In this example, stitches in the background of a girl are not uniformly aligned. Therefore, instructions have been given that the stitches in the background are to be inclined in the upper right direction, so that the stitches are uniformly aligned. As a result, as shown in a preview screen 104 of FIG. 17, the stitching direction in the background is aligned to decrease unconformity.

Figure 18:
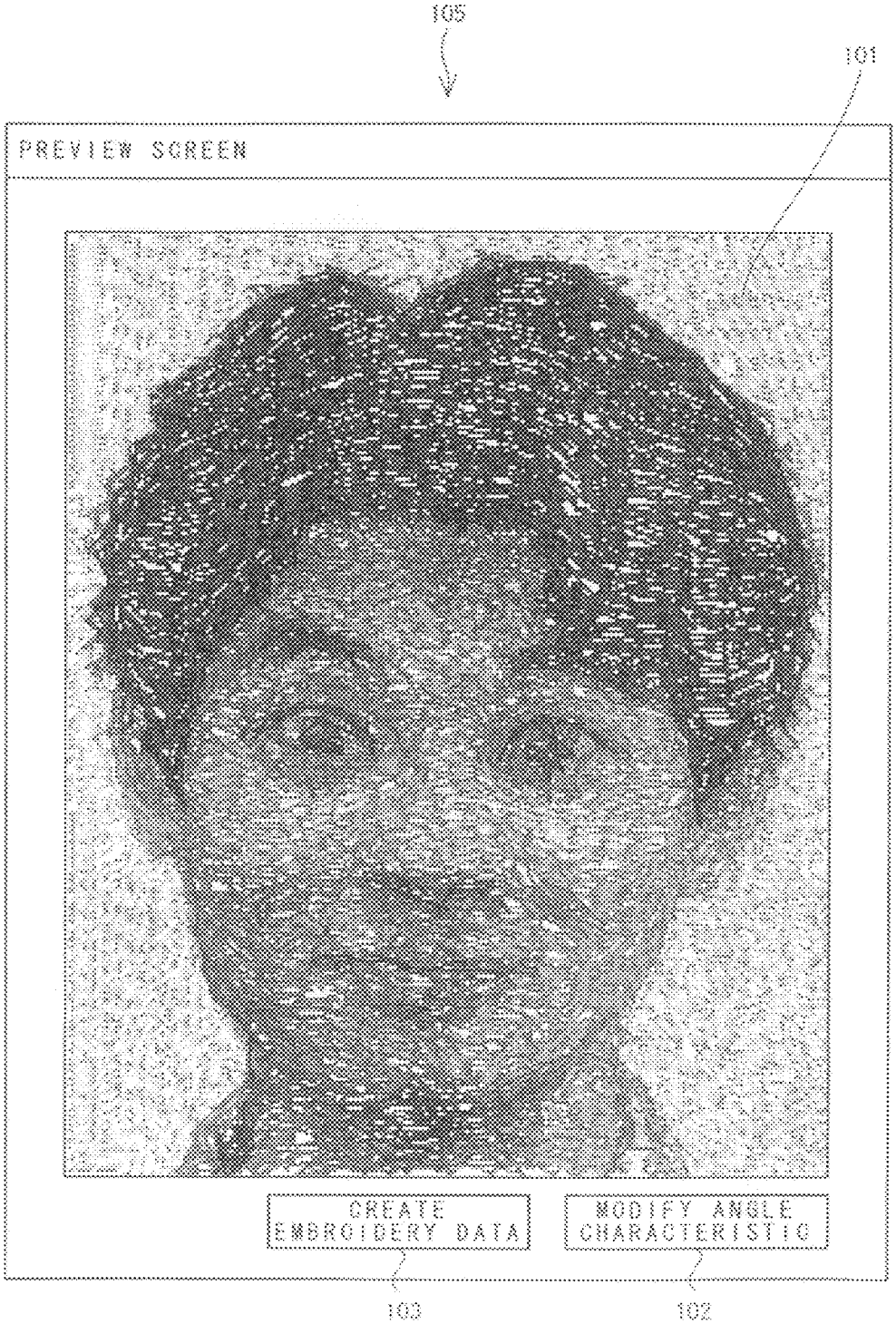
FIG. 18 is an illustration showing the preview screen when a photograph of a face of a man is used as image data.
Figure 19:
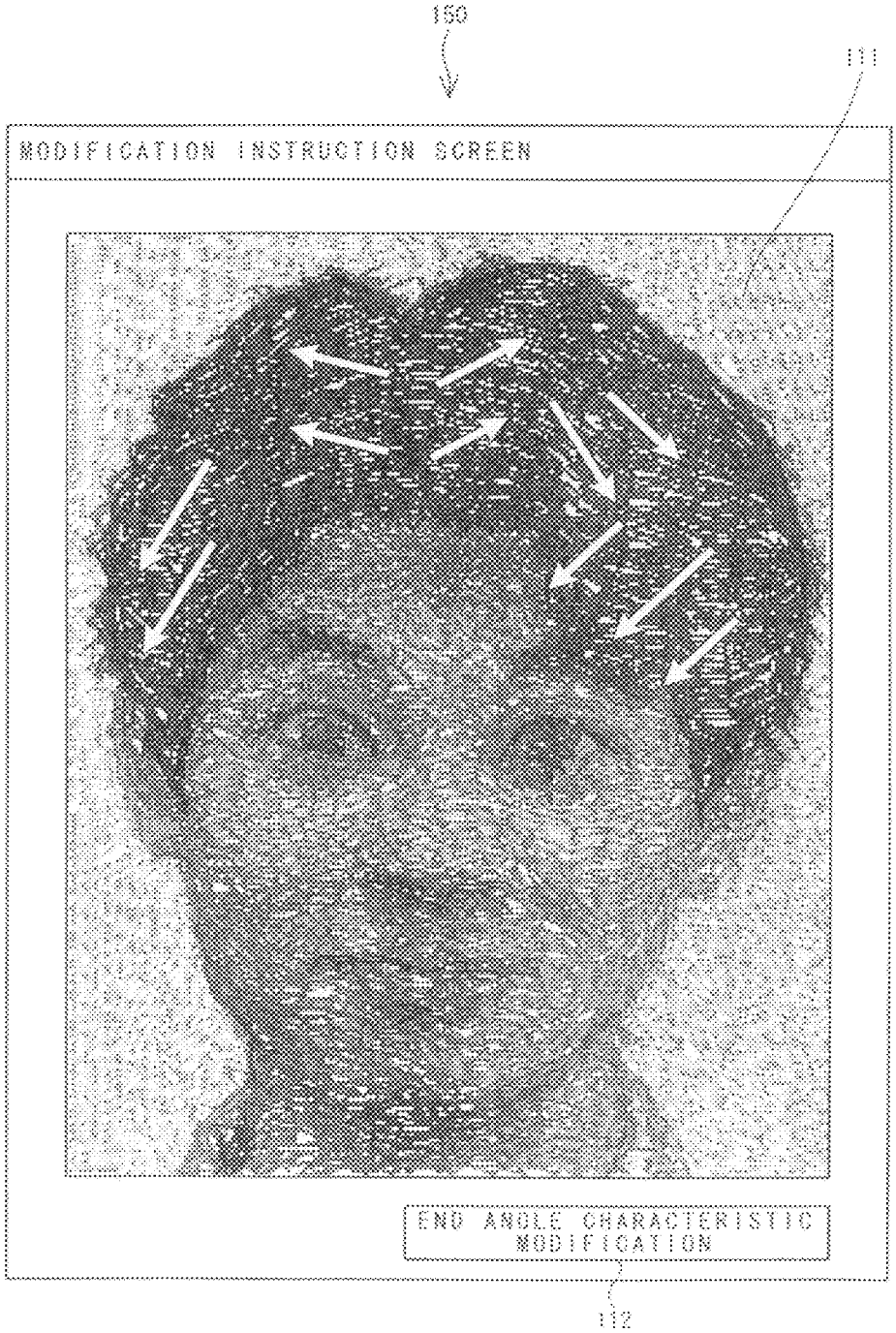
FIG. 19 is an illustration showing the modification instruction screen illustrating the instructions for the angle characteristic modification given on the preview screen shown in FIG. 18.
Figure 20:
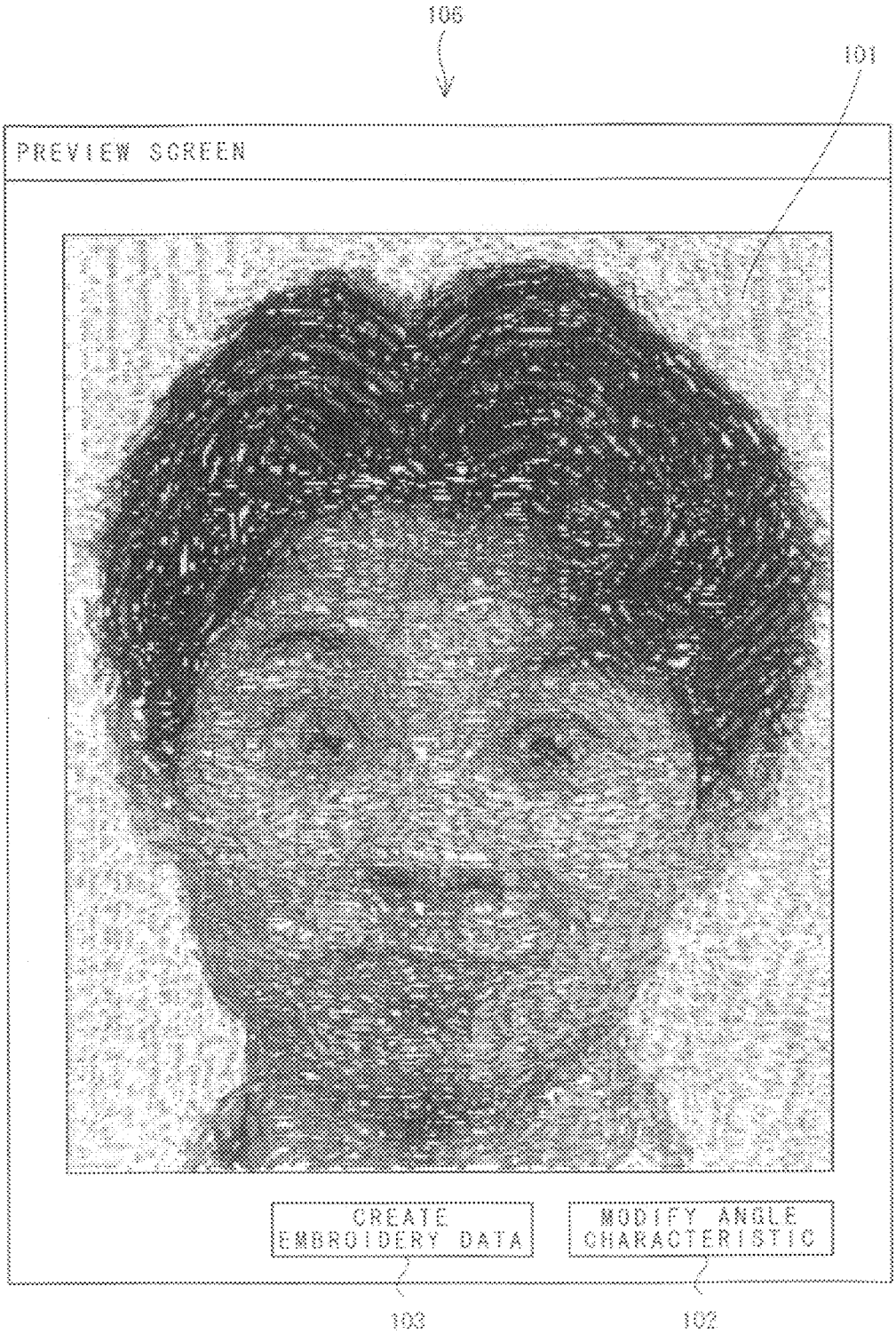
FIG. 20 is an illustration showing the preview screen updated by the modification instructions shown in FIG. 19.
Figure 28:
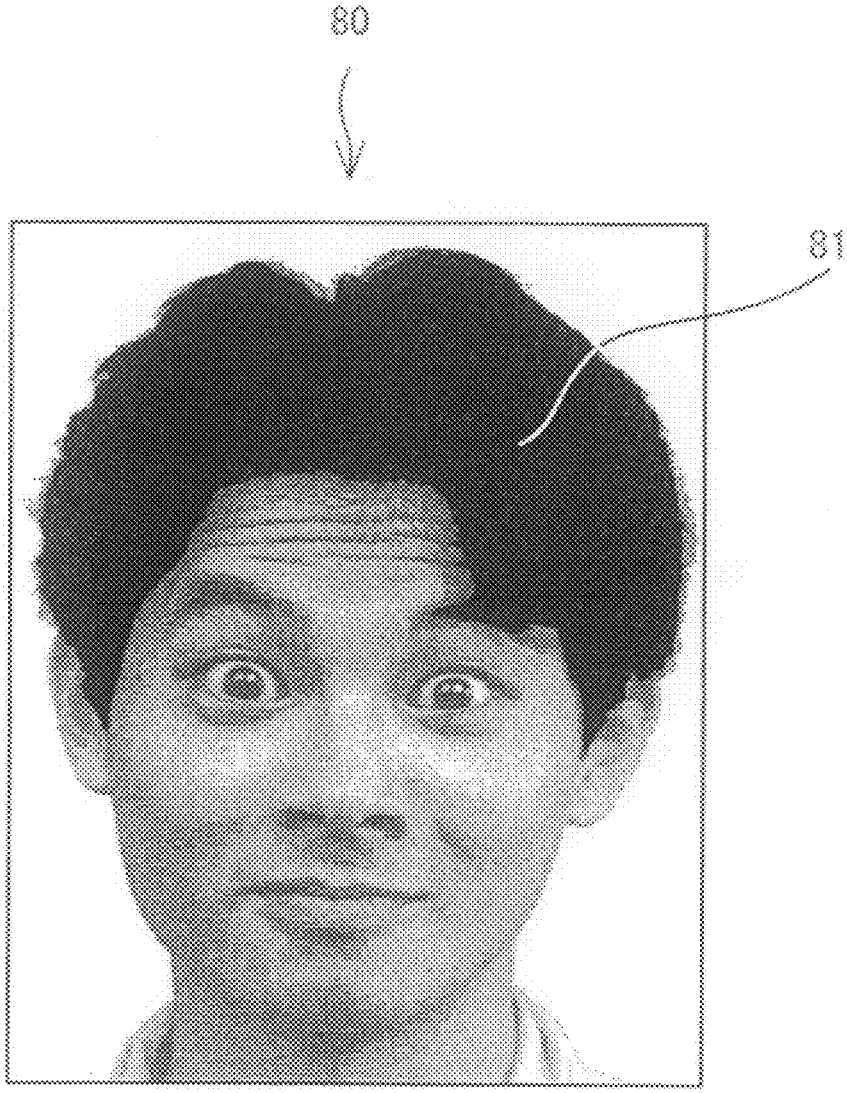
FIG. 28 is an illustration showing another photographic image that provides the source of the design to be embroidered.

Further, in an example shown in FIG. 18, a stitching direction of the hair of a male displayed in a preview image display region 105 does not correspond to an actual flow of the hair. The reason may be that the hair portion in the image data has little difference in luminance so that the hair portion looks like painted with black, as shown in FIG. 28. Therefore, the user may input instructions on a modification instruction screen 150 that the movement trajectory of the mouse pointer 221 of the mouse 22 is made in a direction along the flow of the hair as shown in FIG. 19. In such an example, as shown in FIG. 20, the stitching direction in the hair portion can be directed along the actual flow of the hair so that a beautiful sewing result can be obtained. Thus, the user may instruct a modified angle characteristic as if the user were combing the hair. Therefore, the user can give instructions without a sense of discomfort through easy-to-see and natural operations.

If the angle characteristic modification button 102 is not selected on the preview screen 100, 104, 105, or a preview screen 106 (NO at S10), it is determined whether the embroidery data creation button 103 is selected to instruct creation of the embroidery data in step 17 (S17). If it is not instructed to create the embroidery data either (NO at S17), the process returns to S10, and it is determined again whether modification of the angle characteristic or to creation of the embroidery data is instructed (S10, S17).

If it is instructed to create the embroidery data (YES at S17), the embroidery data is created based on the line segment data and the color data, and stored into the embroidery data storage area 155 in step 18 (S18). The embroidery data is created on the basis of the line segment data and the color data by basically transforming a starting point, an ending point, and a color component that are identified by each line segment data piece into a starting point, an ending point, and a color of a stitch for the same color component. However, if all the line segments are transformed into independent stitches, jump stitches may be generated and the jump stitches may number as many as the number of the line segments. If each of the line segments needs a reinforcement stitch, the sewing quality becomes inferior. Therefore, in order to transform the line segments into continuous stitches without the generation of jump stitches, the following processing is performed.

First, a whole group of line segments identified by the line segment data pieces are subdivided into line segment groups for every color component. Next, in the line segment group of a certain color component, a line segment having an endpoint positioned to the uppermost left point is searched. The identified endpoint positioned to the uppermost left point is assumed as the starting point of the line segment (starting line segment) and the other endpoint thereof is assumed as the ending point. Another line segment having an endpoint closest to this ending point is then searched. The identified endpoint is assumed as the starting point of the next line segment and the other endpoint thereof is assumed as the ending point. By repeating the processing, an order can be determined for the line segments to be sewn in the group of the color component. The same processing is performed on the line segment groups of all the color components. Of course, during the processing, the line segments for which the order is already determined may be excluded from the target of the subsequent searches that determine the order.

As described above, if the user wishes to view a preview image and modify a stitching direction, the user can operate the mouse 22 to arrange the stitching direction. A region in which to arrange the stitching direction can be determined by the user only by dragging the mouse 22 on the preview image. Specifically, a region including two respective pixels, vertically consecutive to pixels (modification target pixels) through which the mouse pointer 221 has passed upon dragging of the mouse 22 is supposed to be a region (modification region) in which the stitching direction is arranged. Further, a direction (angle) in which the user wishes to arrange the stitches can also be determined on the basis of a movement trajectory of the mouse pointer 221 owing to the dragging of the mouse 22. In the present example, an inclination of a straight line to which the modification target pixels are approximated is used as a modified angle characteristic. That is, instead of specifying the inclination of a stitch itself, an angle characteristic, which is used when creating a line segment data that indicates the stitch, can be modified. Therefore, all the stitches in the specified region are not to be aligned in the same specified direction, thereby enabling the creation of stitches that fit in well with the surrounding stitches.

Further, because the angle characteristic intensities of the pixels in the modification region are all modified to the predetermined value (e.g., 80), the pixels having the modified angle characteristics have uniform and relatively large angle characteristic intensity (80% of the maximum value). Such an angle characteristic intensity indicates a high level of continuity of those pixels, so that a possibility becomes higher that a line segment may be created at the relevant position in the line segment data. In the present example the angle characteristic intensities of all of the pixels in the modification region are changed. In the subsequent processing of S5, however, line segments in the modification region are appropriately deleted. Accordingly, it is not likely that too may stitches are formed in the modification region.

Further, after the angle information is modified, the angle characteristic is recalculated (S3). Accordingly, the angle characteristics of the pixels around the modification region are affected by the modified angle characteristics. Therefore, the modification region fits in well with the surroundings when the line segment data is created, thereby enabling natural sewing results.

An embroidery data creation apparatus and a recording medium recording an embroidery data creation program of the present disclosure are not limited to the above-described example and can be changed variously without departing from the scope of the present disclosure.

In the above-described example, with all of the modification target pixels, an approximated straight line is obtained, and the inclination thereof is employed as the modified angle characteristic to modify the angle characteristic. However, a method of calculating the modified angle characteristic is not limited to the method in the example. For example, instead of obtaining the approximated straight line based on all the modification target pixels, the movement trajectory of the mouse pointer 221 may be cut off at a proper length (for example, a length corresponding to a length of 1 cm on the display 24) or with a proper number of pixels, to calculate an approximated straight line for each cut-off movement trajectory. Alternatively, a movement trajectory through the modification target pixels may be approximated to a straight line for each of the modification target pixels, to provide the inclination thereof as the modified angle characteristic. Further, instead of approximating the modification target pixels to a straight line, a tangent line may be obtained, and the inclination thereof can be employed.

Further, the inclination of the movement trajectory of the mouse pointer 221 may not be used as the modified angle characteristic. For example, in determining the modified angle characteristic, a certain degree of modification may be applied to the inclination of the movement trajectory of the mouse pointer 221 through dragging of the mouse 22. The degree of modification may be a preset value or inputted by the user for each time. A method of determining the modified angle characteristic applying the degree of modification is described below with reference to FIGS. 21 to 23. Similar to the above-described example, a modification region is assumed to correspond to two respective pixels (neighboring pixels) consecutive to the modification target pixels in each of the vertical and horizontal directions. A degree of modification is assumed as 50%. In an example shown in FIG. 21, the angle characteristics of pixels are all assumed as 120 for ease of explanation.

Figure 21:
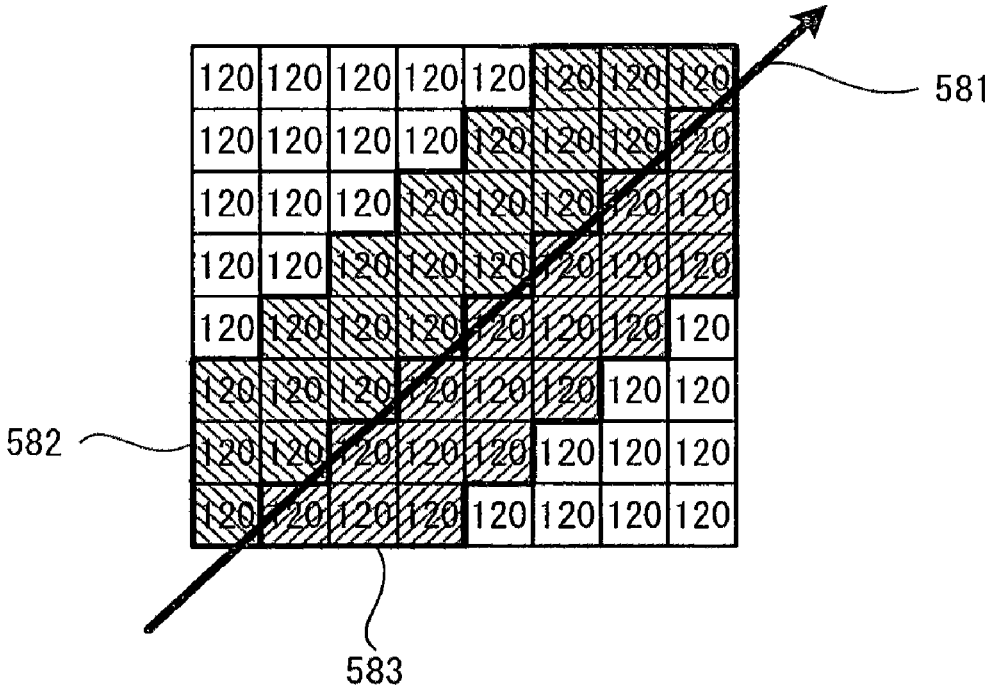
FIG. 21 is a schematic diagram showing movement trajectory of a mouse pointer and a modification region with respect to the angle characteristics of some pixels.

An inclination of a movement trajectory 581 shown in FIG. 21 is 45°. The modification target pixels through which the movement trajectory 581 has passed and the neighboring pixels are assumed to constitute modification regions 582 and 583. The modification region 582 includes pixels that are present on the left side of a direction in which the movement trajectory 581 advances, and the modification region 583 includes pixels that are present on the right side of the direction in which the movement trajectory 581 advances. The modification target pixel, through which the movement trajectory 581 passes, may be included in either of the left-hand modification region 582 and the right-hand modification region 583, depending on two subdivided regions thereof. More specifically, the modification target pixel is assumed to be included in the left-hand modification region 582 if a left-hand subdivided region is larger than the other right-hand subdivided region. On the other hand, the modification target pixel is assumed to be included in the right-hand modification region 583 if the right-hand subdivided region is larger than the other left-hand subdivided region. In the following description, the angle characteristic of the left-hand modification region 582 is represented by K1, the angle characteristic of the right-hand modification region 583 is represented by K2, the inclination of the movement trajectory 581 is represented by θ, and the degree of modification is represented by a, respectively.

First, the inclination θ of the movement trajectory is corrected into a range of $-180 \leqq \theta < 180$. In this example, because the inclination $\theta=45$, it is not necessary to correct the inclination θ. On the other hand, if the inclination $\theta=270$, for example, 360° is subtracted from the inclination q thereby obtaining the corrected inclination θ as $270-360=-90$.

Figure 22:
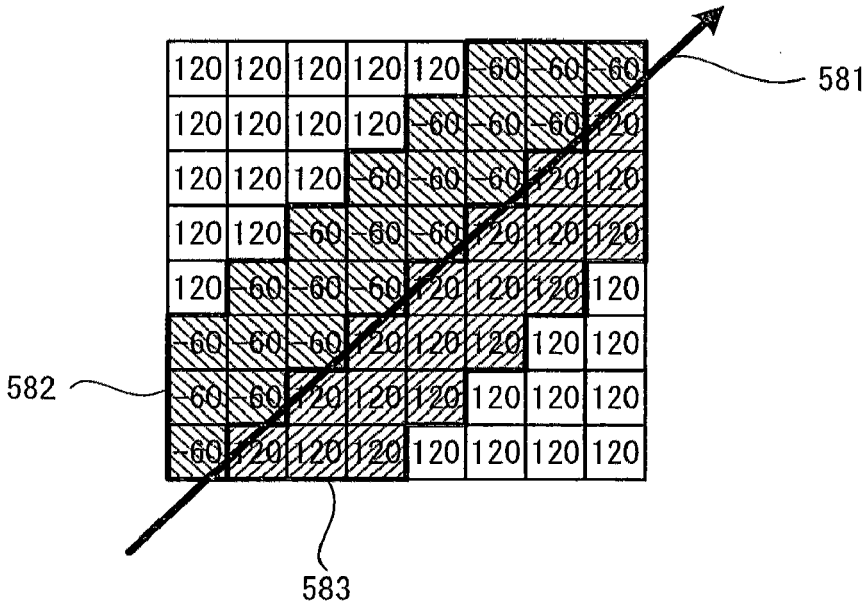
FIG. 22 is a schematic diagram showing a process of calculating the angle characteristics of those pixels shown in FIG. 21.

Subsequently, the angle characteristic K1 of the left-hand modification region 582 may be corrected to be $\theta \leqq K1 < \theta + 180$, and the angle characteristic K 2 of the right-hand modification region 583 may be corrected to be $\theta - 180 \leqq K2 < \theta$. More specifically, if K1 does not satisfy $\theta \leqq K1 < \theta + 180$, 180 is added to K1. If K2 does not satisfy $\theta - 180 \leqq K2 < \theta$, 180 is subtracted from K2. In the example shown in FIG. 21, because the inclination $\theta = 45$, the angle characteristics K1 and K2 are respectively corrected to satisfy $45 \leqq K1 < 225$ and $-135 \leqq K2 < 45$. In this example, it is not necessary to correct the angle characteristic K1 of the left-hand modification region 582, because K1 is 120 (K1=120) and the relationship of $45 \leqq K1 < 225$ is satisfied. On the other hand, the angle characteristic K2 (K2=120) of the right-hand modification region 583 does not satisfy $-135 \leqq K2 < 45$. Therefore, K 2 is corrected as $120 - 180 = -60$. FIG. 22 shows a state in which the angle characteristics have been corrected.

Figure 23:
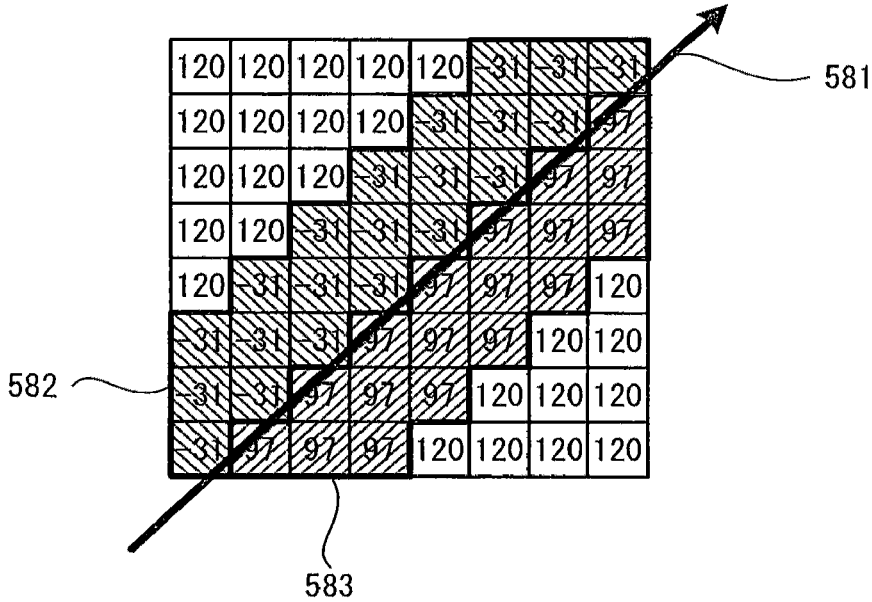
FIG. 23 is a schematic diagram showing modified angle characteristics of those pixels shown in FIG. 21.

Subsequently, the modified angle characteristic is calculated in accordance with the following Equation (5). In FIG. 22, in the left-hand modification region 582, the modified angle characteristic can be obtained as $\tan^{-1}\{(\sin 120 + \sin 45 \times 0.5)/(\cos 120 + \cos 45 \times 0.5)\} \approx -83.15$. The angle characteristic K1 of the left-hand modification region 582 has to satisfy $\theta \leqq K1 < \theta + 180$, that is, $45 \leqq K1 < 255$. Therefore, for the purpose of correction, 180 is added to the obtained value to provide $-83.15 + 180 = 96.847 \approx 97$. In the right-hand modification region 583, the modified angle characteristic is $\tan^{-1}\{(\sin -60 + \sin 45 \times 0.5)/(\cos -60 + \cos 45 \times 0.5)\} \approx -30.98 \approx -31$. The angle characteristic K2 of the right-hand modification region 583 needs to satisfy $\theta - 180 \leqq K2 < \theta$, that is, $-135 \leqq K2 < 45$. Because the modified angle characteristic K2 satisfies this condition, it is not necessary to correct K2. FIG. 23 shows the modified angle characteristics in the modification region obtained as described above.

$$\text{Modified Angle Characteristic} = \tan^{-1}\{(\sin k + \sin \theta \cdot a)/(\cos K + \cos \theta \cdot a)\} \quad (5)$$

In such a manner, the angle characteristics are modified based on the degree of modification and the movement trajectory of the mouse pointer 221. Although in the above example, the degree of modification is set as 50%, the degree may not be a fixed value. For example, the degree of modification may be determined so as to correspond to a movement speed of the mouse pointer 221 through dragging of the mouse 22. The speed can be calculated from a period of time during which the mouse 22 has been dragged and a length of the movement trajectory (or n number of dots on the display 24). Alternatively, the degree of modification may be set corresponding to a movement speed beforehand. For example, the degree of modification may be set to 10% when the movement speed is 1 cm/s or less, while the degree of modification may be set to 20% when the movement speed is between 1 cm/s and 2 cm/s, both inclusive. In this example, the higher the movement speed is, the greater the degree of modification may be set. Conversely, the degree of modification may be set smaller as the movement speed becomes higher. The user may select whether to increase or to decrease the degree of modification as the movement speed becomes higher. The user may also set at what percentage to set the degree of modification for the value that the movement speed takes on.

The modified angle characteristic may not necessarily be determined on the basis of the movement trajectory of the mouse pointer 221 made by dragging of the mouse 22. For example, the modified angle characteristic may be inputted by the user as a numerical value. In such an example, it is only necessary to provide a modified angle characteristic input field on the modification instruction screens 110 and 150 to accept an inputted value as the modified angle characteristic. The modified angle characteristic can be stored into the angle information storage area 152 as the angle characteristics of the pixels in the modification region.

In the above example, the modification region is constituted of a region corresponding to two respective pixels that are consecutive to the modification target pixels in each of the vertical and horizontal directions. However, the number of the pixels that define the modification region is not limited to two. The direction in which the pixels that define the modification region are consecutive is not limited to the vertical direction and the horizontal direction, but may be an oblique direction or may be only the vertical or horizontal direction. If the pixels that define the modification region are consecutive only in the vertical direction, it may be necessary to change the inclination of the approximated straight line into the horizontal direction, if the inclination of the approximated straight line is 90° or 270°. If the pixels that define the modification region are consecutive only in the horizontal direction, similarly, it may be necessary to change the inclination of the approximated straight line into the vertical direction, if the inclination of the approximated straight line is 0° or 180°. Further, the modification region may be determined based on a distance from the movement trajectory of the mouse pointer 221, instead of the number of the pixels. Further, neither the number of the pixels consecutive to the modification target pixel nor the distance from the movement trajectory may be preset, so that they may be set by the user. In addition, the direction in which the pixels are consecutive may be set by the user.

The number of pixels consecutive to the modification target pixel and the distance from the movement trajectory may be determined on the basis of the movement speed of the mouse pointer 221 of the mouse 22. For example, they can be set beforehand to a number of pixels and a distance that corresponds to a speed. For example, the number of pixels may be set to one, when the movement speed is 1 cm/s or less, and may be set to two when the movement speed is between 1 cm/s and 2 cm/s, both inclusive. In this example, the higher the movement speed is, the larger the number of the pixels may be set. Conversely, the number of pixels may be set smaller as the movement speed becomes higher. The user may select whether to increase or to decrease the number of pixels as the movement speed becomes higher. The user may also set how many pixels are to be employed at which value the movement speed takes on.

In the above example, the modification region is determined based on the movement trajectory of the mouse pointer 221 made by dragging of the mouse 22. The method of determining the modification region is, however, not limited to this method. For example, the user may specify an arbitrary closed region in the preview image display region 111 by using the mouse 22 so that the closed region may be employed as a modification region.

Figure 24:
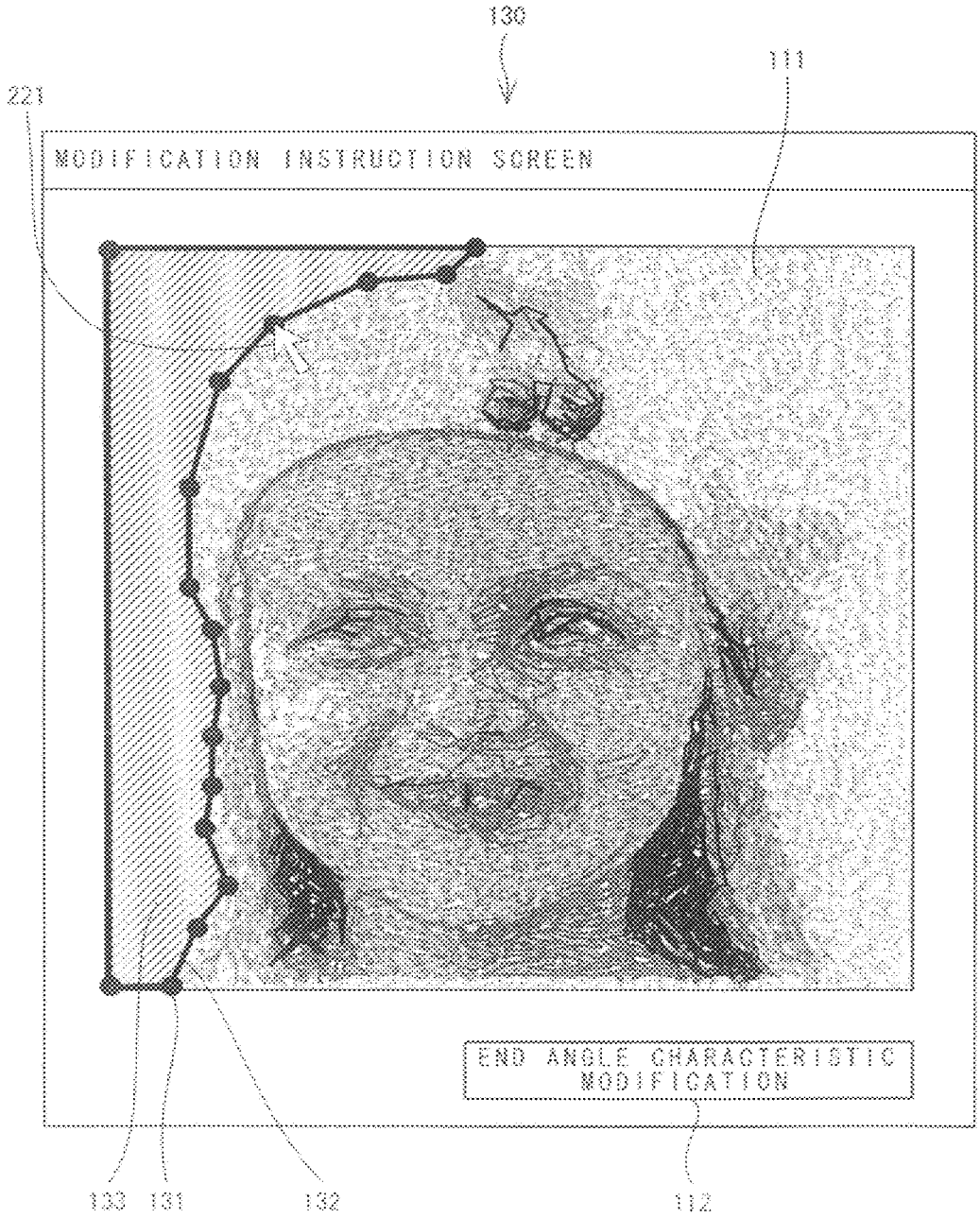
FIG. 24 is an illustration showing the modification instruction screen when specifying a closed region in a preview image display region.

For example, a closed region filled with hatched lines in the preview image display region 111 of FIG. 24 is a modification region 133. Although the modification region 133 is filled with the hatched lines in FIG. 24 for ease of understanding, the modification region 133 need not be filled on the modification instruction screen 130 so that the preview image may be seen. Points 131 on a borderline of the modification region 133 is points (click point 131) at which the mouse 22 has been clicked. In FIG. 24, not all of the click points 131 are indicated by a symbol to avoid complication. If the mouse 22 is clicked at an arbitrary point in the preview image display region 111, the position of the point is stored in a predetermined storage area of the RAM 12, and a round mark is displayed at the position as shown in FIG. 24, in the preview image display region 111. If the mouse is clicked at an arbitrary point in the preview image display region 111, the coordinates of that point are subsequently stored in the RAM 12. Further, a line segment interconnecting the earlier click point 131 and the current click point 131 is calculated and displayed as a borderline 132 in the preview image display region 111. Not all of the borderlines 132 are indicated by a symbol in FIG. 24 to avoid complication.

In such a manner, the user may be permitted to specify the borderline of the closed region in the preview image display region 111. If the mouse is clicked again at the click point 131 that is specified first, the borderline 132 is closed to form the closed region. The region enclosed by a group of the borderlines 132 is provided as the modification region 133. The line segments interconnecting the respective click points 131 are not limited to such straight lines as shown in FIG. 24, but may include curves or a combination of curves and straight lines.

Figure 25:
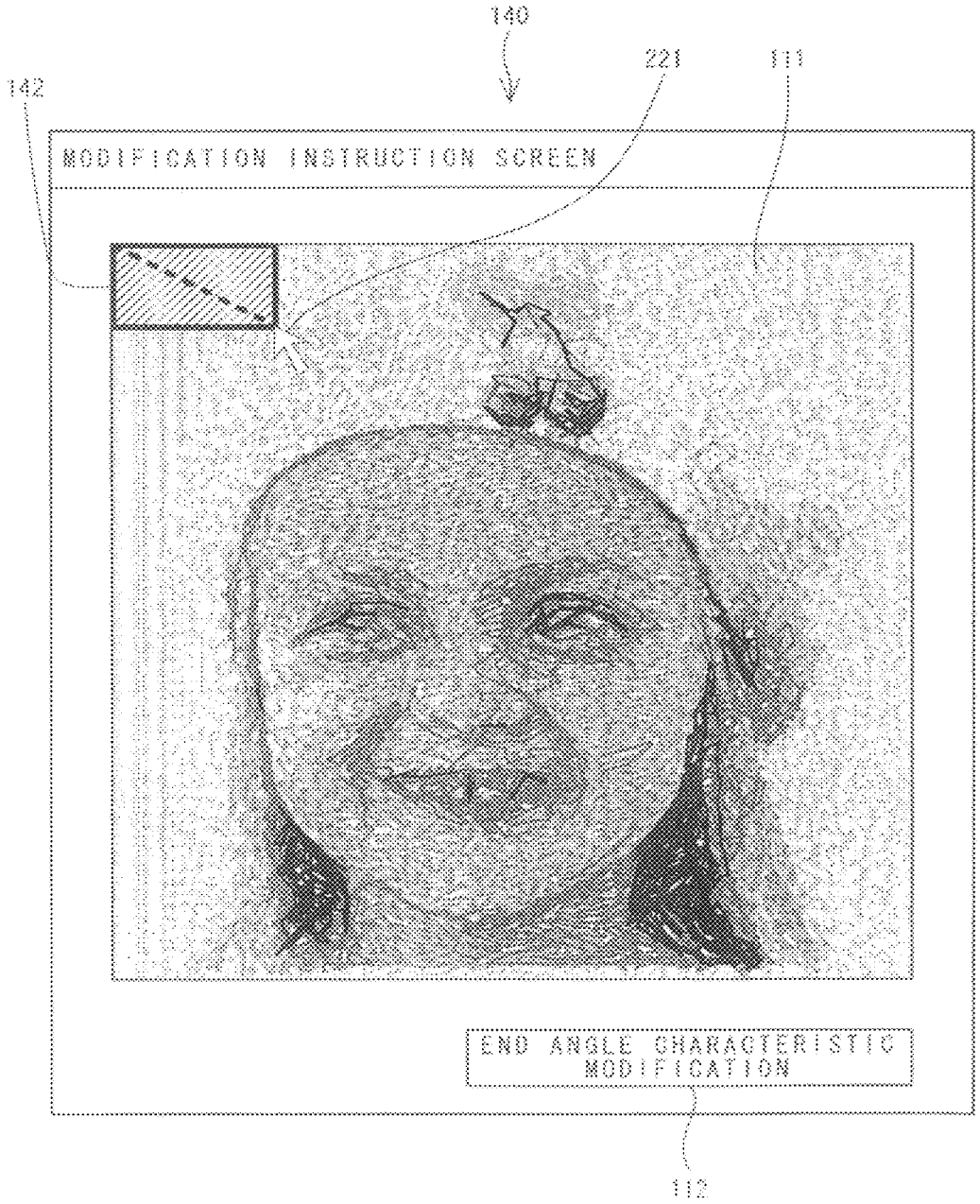
FIG. 25 is an illustration showing the modification instruction screen when specifying another closed region in the preview image display region.
Figure 26:
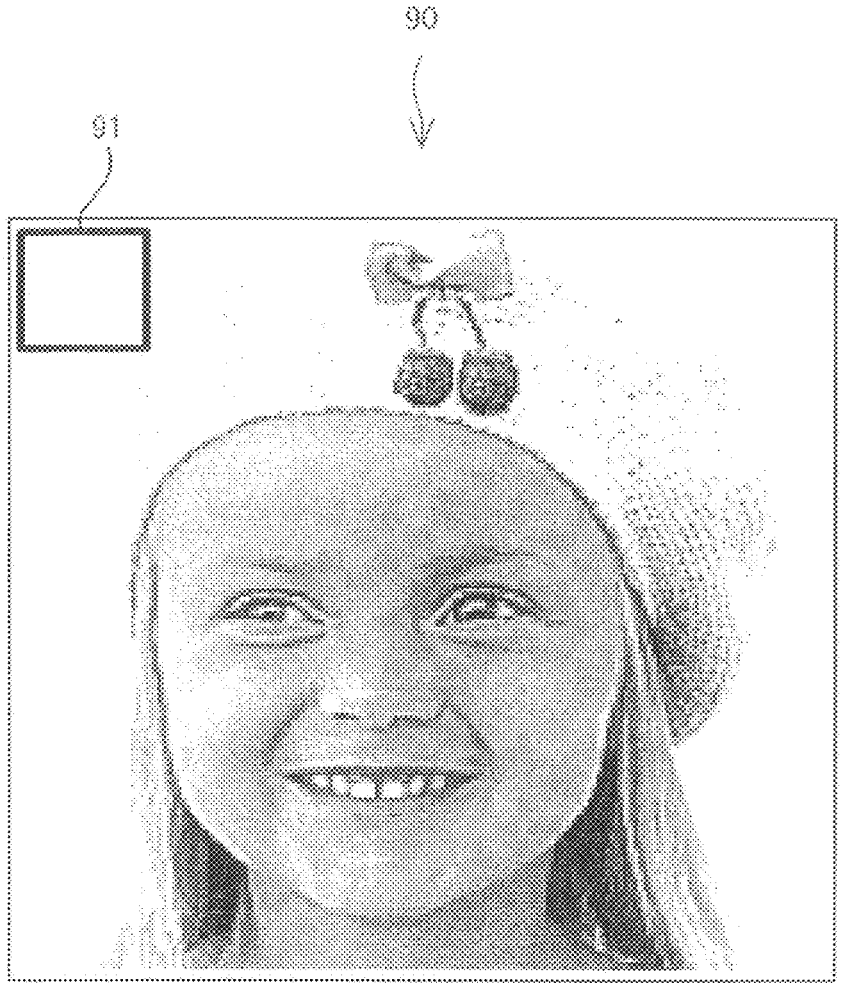
FIG. 26 is an illustration showing an original photographic image that provides a source of a design to be embroidered.
Figure 27:
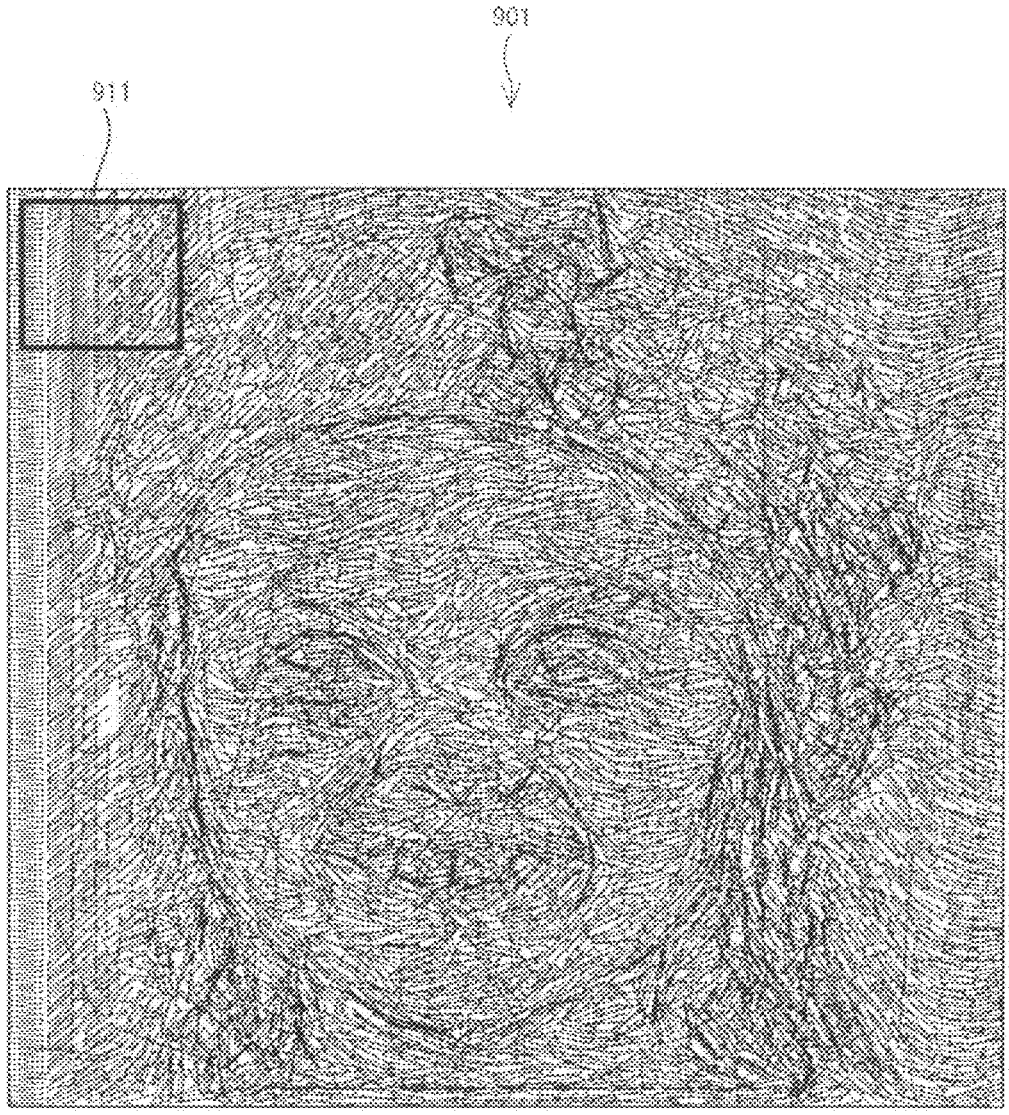
FIG. 27 is an illustration showing line segment data that is created on the basis of angle characteristics and angle characteristic intensities calculated from the photographic image shown in FIG. 26.

Instead of a closed region that is formed by linking points at which the mouse is clicked, the user may drag the mouse 22 freehand, and the closed region may be formed by using the movement trajectory of the mouse pointer 221 as the borderline. In this example, if the movement trajectory of the mouse pointer 221 is not closed, a starting point and an ending point of the movement trajectory can be connected to each other to form the closed region. Further, as shown in FIG. 25, an inside region of a rectangle (a closed region) having a line segment interconnecting a starting point and an ending point of dragging of the mouse 22 as a diagonal line may be employed as the modification region. Further, instead of a rectangle, the closed region to be employed as the modification region may be a circle or an ellipsoid having a line segment interconnecting a starting point and an ending point of dragging of the mouse 22 as the diameter, or may be a rectangle having curved vertexes.

The user may be permitted to select the method of determining the modification region. For example, when it is desired to modify the sewing direction of a background as a whole, a region in which the user desires to change the sewing direction is clear. Therefore, it may be easier for the user to specify the modification region by specifying a closed region, than to determine the neighboring pixels around the movement trajectory of the mouse pointer 221, as the modification region as described in the example. On the other hand, as in the example shown in FIG. 19, when it is desired to modify the sewing direction of the hair, it may be preferable to not clearly delimit the modification region. Therefore, it may be easier for the user to specify the sewing direction as if he or she were combing the hair, determining the neighboring pixels around the movement trajectory of the mouse pointer 221 as the modification region as described in the example. Therefore, it is possible to provide a plurality of methods for determining the modification region so that the user can select a desired method, thereby enabling the instruction for the modification that is suitable for the situation of a portion to be modified.

In the above example, the angle information is changed and then the angle characteristic is recalculated at S3. However, it may not be necessary to recalculate the angle characteristic. The user may be permitted to select whether to recalculate the angle characteristic when instructing the modification. In such an example, if it is selected to recalculate the angle characteristic, after S16, the process returns to S3 to recalculate the angle characteristic. On the other hand, if it is not selected to recalculate the angle characteristic, after S16, the process may return to S4 so that recalculation is not performed. If the angle characteristic is not recalculated, the direction of the line segment created from the pixel for which the angle information has been changed may not fit in very well with the directions of line segments created from the surrounding pixels. Therefore, if it is not desired that the direction of a certain line segment fits in well with the directions of the surroundings, recalculation should not be performed in order to obtain preferable sewing results. For example, if it is desired to modify the sewing direction of the background as a whole as shown in FIG. 24, it may be preferable that the stitching direction of the background does not fit in well with the surroundings, because the background is independent of the hair or the cap of the girl. Therefore, if recalculation is not performed, preferable sewing results may be obtained. On the other hand, if it is desired to modify the sewing direction of the hair as in the example shown in FIG. 19, the modified stitching direction of the hair may preferably fit in well with the stitching direction of the surroundings of the modification region, because it may give a look of an apparently natural flow of the hair. Therefore, recalculation should be performed in order to obtain preferable sewing results.

In the above example, a value in the range between 0 and 100 is used to represent the angle characteristic intensity, the value range for the angle characteristic intensity is not limited to this range. Further, in the example, the angle characteristic intensity is changed to a preset value (e.g., 80), but the preset value is not limited to this specific value. It may not be necessary to change the angle characteristic intensity. The user may be permitted to specify a value to which the angle characteristic intensity is changed or to select whether to change the angle characteristic intensity or not. A higher value of the angle characteristic intensity makes it more likely that a line segment having an inclination along the movement trajectory specified by the user is created at the position of this pixel than at the surrounding pixels when creating line segment data.

In the above example, after the modification termination button 112 is selected, the line segment data and the color data is created again to update the preview image. However, the preview image may be updated each time the mouse 22 is dragged. Although the embroidery data creation program is stored in the CD-ROM 114 in the example, the recording medium is not limited to a CD-ROM, but may be any other recording medium such as a flexible disk or a DVD.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data creation apparatus that creates embroidery data to be used for embroidery sewing by a sewing machine based on image data constituted by an aggregation of a plurality of pixels to form an arbitrary image, the apparatus comprising:

an angle information calculation device that calculates an angle characteristic and an angle characteristic intensity for each of the pixels constituting the image data, the angle characteristic indicating a direction with a high continuity of a color, and the angle characteristic intensity indicating an intensity of the continuity;

an angle information storage device that stores the angle characteristic and the angle characteristic intensity calculated by the angle information calculation device as angle information;

a region specification device that specifies a change region in which the angle information stored in the angle information storage device is to be changed;

an angle characteristic specification device that specifies a post-change angle characteristic, the post-change angle characteristic being a post-change quantity of the angle characteristic stored in the angle information storage device;

an angle characteristic change device that changes the respective angle characteristics of pixels included in the change region specified by the region specification device based on the post-change angle characteristic specified by the angle characteristic specification device, and that stores the angle characteristics into the angle information storage device after the angle characteristics are changed;

a line segment data creation device that creates line segment data that indicates line segments based on the angle information stored in the angle information storage device, the line segments each being a trajectory of a thread to be disposed on each of the pixels;

a color data creation device that creates color data that indicates a thread color for each of the line segments contained in the line segment data created by the line segment data creation device based on the image data; and an embroidery data creation device that creates the embroidery data based on the line segment data created by the line segment data creation device and the color data created by the color data creation device.

2. The embroidery data creation apparatus according to claim 1, further comprising an angle characteristic intensity change device that changes the respective angle characteristic intensities of the pixels included in the change region specified by the region specification device to a predetermined value, and stores the angle characteristic intensities into the angle information storage device after the angle characteristic intensities are changed.

3. The embroidery data creation apparatus according to claim 1, further comprising an angle characteristic recalculation device that, for a pixel or a group of pixels each of which has the angle characteristic intensity stored in the angle characteristic storage device smaller than a preset threshold value, recalculates a new angle characteristic that refers to the angle characteristic of a surrounding pixel or a group of surrounding pixels, and changes the angle characteristic stored in the angle characteristic storage device.

4. The embroidery data creation apparatus according to claim 1, further comprising:

a display device that displays an image;

a preview display control device that displays a preview image on the display device, the preview image being an image that represents a presumed result of embroidery sewing according to the embroidery data created by the embroidery data creation device; and a position specification device that specifies a position on the image displayed on the display device, wherein the region specification device specifies a region that is determined on the basis of trajectory positions specified by the position specification device on the preview image as the change region.

5. The embroidery data creation apparatus according to claim 4, wherein the region specification device specifies, as the change region, a region constituted of trajectory pixels and pixels positioned in a predetermined direction out of a predetermined number of pixels that are respectively consecutive to the trajectory pixels, the trajectory pixels being pixels corresponding to the trajectory of the positions specified by the position specification device on the preview image.

6. The embroidery data creation apparatus according to claim 5, further comprising:

a speed calculation device that calculates a movement speed of the position specification device at a time when the position is specified by the position specification device on the preview image, wherein the region specification device determines the predetermined number of the pixels that are respectively consecutive to the trajectory pixels based on the trajectory of the positions specified by the position specification device and the speed calculated by the speed calculation device.

7. The embroidery data creation apparatus according to claim 1, further comprising:

a display device that displays an image;

a preview display control device that displays a preview image on the display device, the preview image being an image that represents a presumed result of embroidery sewing according to the embroidery data created by the embroidery data creation device; and a position specification device that specifies a position on the image displayed on the display device, wherein the region specification device specifies a closed region formed by linking the positions specified in series by the position specification device on the preview image as the change region.

8. The embroidery data creation apparatus according to claim 1, further comprising:

a display device that displays an image;

a preview display control device that displays a preview image on the display device, the preview image being an image that represents a presumed result of embroidery sewing according to the embroidery data created by the embroidery data creation device;

a position specification device that specifies a position on the image displayed on the display device; and an inclination calculation device that calculates an inclination of a trajectory of the positions specified by the position specification device on the preview image, wherein the angle characteristic specification device specifies the inclination calculated by the inclination calculation device or a value obtained on the basis of the inclination calculated by the inclination calculation device as the post-change angle characteristic.

9. The embroidery data creation apparatus according to claim 1, further comprising:

a display device that displays an image;

a preview display control device that displays a preview image on the display device, the preview image being an image that represents a presumed result of embroidery sewing according to the embroidery data created by the embroidery data creation device;

a position specification device that specifies a position on the image displayed on the display device; and a speed calculation device that calculates a movement speed of the position specification device at a time when the position is specified by the position specification device on the preview image, wherein the angle characteristic specification device specifies a value calculated on the basis of the speed calculated by the speed calculation device as the post-change angle characteristic.

10. The embroidery data creation apparatus according to claim 1, wherein:

the angle characteristic specification device includes a numeral input device that inputs the post-change angle characteristic as a numerical value; and the angle characteristic specification device specifies the numerical value inputted by the numeral input device as the post-change angle characteristic.

11. A non-transitory computer-readable recording medium storing an embroidery data creation program that creates embroidery data to be used for embroidery sewing by a sewing machine based on image data constituted by an aggregation of a plurality of pixels to form an arbitrary image, the program comprising:

instructions for calculating an angle characteristic and an angle characteristic intensity for each of the pixels constituting the image data, the angle characteristic indicating a direction with a high continuity of a color, and the angle characteristic intensity indicating an intensity of the continuity;

instructions for storing the angle characteristic and the angle characteristic intensity that are calculated as angle information;

instructions for specifying a change region in which the angle information stored is to be changed;

instructions for specifying a post-change angle characteristic, the post-change angle characteristic being a post-change quantity of the angle characteristic stored;

instructions for changing the respective angle characteristics of pixels included in the change region specified, based on the post-change angle characteristic specified, and storing the angle characteristics after the angle characteristics are changed;

instructions for creating line segment data that indicates line segments based on the angle information stored, the line segments each being a trajectory of a thread to be disposed on each of the pixels;

instructions for creating color data that indicates a thread color for each of the line segments created, based on the image data; and instructions for creating the embroidery data based on the line segment data and the color data that are created.

12. The recording medium according to claim 11, the program further comprising instructions for changing the respective angle characteristic intensities of the pixels included in the change region specified to a predetermined value and storing the angle characteristic intensities after the characteristic intensities are changed.

13. The recording medium according to claim 11, the program further comprising instructions for recalculating a new angle characteristic that refers to the angle characteristic of a surrounding pixel or a group of surrounding pixels, and changing the angle characteristic stored, for a pixel or a group of pixels each of which has the angle characteristic intensity stored smaller than a preset threshold value.

14. The recording medium according to claim 11, the program further comprising:

instructions for displaying a preview image that is an image that represents a presumed result of embroidery sewing according to the embroidery data created; and instructions for specifying a position on the preview image displayed, wherein the instructions for specifying the change region specifies a region that is determined on the basis of a trajectory of positions specified on the preview image as the change region.

15. The recording medium according to claim 14, wherein the instructions for specifying the change region specifies, as the change region, a region constituted of a trajectory pixels and pixels positioned in a predetermined direction out of a predetermined number of pixels that are respectively consecutive to the trajectory pixels, the trajectory pixels corresponding to the trajectory of the positions specified on the preview image.

16. The recording medium according to claim 15, the program further comprising instructions for calculating a movement speed of a position specification device that specifies a position on the preview image at a time when the position is specified by the position specification device on the preview image, wherein the instructions for specifying the change region determines the predetermined number of the pixels that are respectively consecutive to the trajectory pixels based on the trajectory of the positions and the movement speed calculated according to the instructions for calculating the movement speed.

17. The recording medium according to claim 11, the program further comprising:

instructions for displaying a preview image that is an image representing a presumed result of embroidery sewing according to the embroidery data created; and instructions for specifying a position on the preview image displayed, wherein the instructions for specifying the change region specifies a closed region formed by linking the positions specified in series on the preview image as the change region.

18. The recording medium according to claim 11, the program further comprising:

instructions for displaying a preview image that is an image representing a presumed result of embroidery sewing according to the embroidery data created;

instructions for specifying a position on the preview image displayed; and instructions for calculating an inclination of the trajectory of the positions specified on the preview image, wherein the instructions for specifying the post-change angle characteristic specifies the inclination calculated or a value obtained on the basis of the inclination calculated as the post-change angle characteristic.

19. The recording medium according to claim 11, the program further comprising:

instructions for displaying a preview image that is an image representing a presumed result of embroidery sewing according to the embroidery data created;

instructions for specifying a position on the preview image displayed; and instructions for calculating a movement speed of a position specification device that specifies a position on the preview image displayed at a time when the position is specified by the position specification device on said preview image, wherein the instructions for specifying the post-change angle characteristic specifies a value calculated on the basis of the speed calculated as the post-change angle characteristic.

20. The recording medium according to claim 11, wherein the instructions for specifying the post-change angle characteristic includes instructions for inputting the post-change angle characteristic as a numerical value, and specifies the numerical value inputted as the post-change angle characteristic.

* * * * *